US005570591A

United States Patent [19]

Frullini et al.

[11] Patent Number: 5,570,591

[45] Date of Patent: Nov. 5, 1996

[54] METHOD AND APPARATUS FOR SEAMING TWO EDGES OF A KNITTED TUBULAR ARTICLE UPON COMPLETION THEREOF

[75] Inventors: Alberto Frullini; Paolo Frullini, both of Florence, Italy

[73] Assignee: Fabritex S.R.L., Florence, Italy

[21] Appl. No.: 422,884

[22] Filed: May 10, 1995

Related U.S. Application Data

[63] Continuation-in-part of Ser. No. 133,651, Oct. 7, 1993, abandoned.

[30] Foreign Application Priority Data

Sep. 10, 1992 [IT] Italy ..... FI 92 A 194

[51] Int. Cl.[6] ..... D04B 9/56; D04B 35/00

[52] U.S. Cl. ..... 66/58; 66/148

[58] Field of Search ..... 66/11, 13, 21, 66/43, 46, 47, 48, 49, 58, 148

[56] References Cited

FOREIGN PATENT DOCUMENTS 2108090 4/1994 Canada .
0592376 4/1994 European Pat. Off. .

*Primary Examiner*—John J. Calvert
*Attorney, Agent, or Firm*—McGlew and Tuttle

[57] ABSTRACT

A method for seaming two edges of a knitted tubular article to make the tubular article with a single-cylinder circular machine, starting from the elastic hem and finishing at the side of the toe which is left open. The method includes: (a) lifting a predetermined number of needles of a first semiring; (b) lifting further up the needles to remove the relevant stitches; (c) lifting at the same height a predetermined number of needles together with the stitches of the second semiring; (d) removing the stitches; (e) lowering the needles of the first semiring; (f) transferring the thus removed stitches, by overturning them, onto the relevant needles of the second semiring; (g) lifting the needles of the second semiring; (h) locating the pairs of overlapping stitches of each needle of the second semiring closely juxtaposed and coaxial to each other; (i) lifting further the needles of the second semiring; rotating with intermittent motion the needles cylinder and inserting step-by-step a linking needle within a pair of stitches thus lifted by providing it with the thread (F) used for the knitting of the article, without loss of continuity, and then removing it to make a linking stitch; (m) carrying out two or more knots after having executed the last linking stitch; (n) cutting the thread (F); (o) lowering the needles of the first semiring down to its cast off position.

27 Claims, 34 Drawing Sheets

METHOD AND APPARATUS FOR SEAMING TWO EDGES OF A KNITTED TUBULAR ARTICLE UPON COMPLETION THEREOF

This is a continuation-in-part application of application Ser. No. 08/133,651, filed Oct. 7, 1993, abandoned.

FIELD OF THE INVENTION

The present invention refers to a method and apparatus for seaming of two edges of a knitted tubular article, such as the linking of socks toe, upon completion of the knitting of the article.

BACKGROUND OF THE INVENTION

It is known that socks are produced with circular machines having one or two needle cylinders, the knitting starting from the elastic hem and finishing at the toe side which is left open to be closed afterwards by suitable seaming or linking machines. More precisely, it is known that after the formation of the necessary ranks (the term rank being used herein to refer to a knit course or stitch course and the term semi rank being used herein to refer to half of a knit course or partial knit course) for—the sock toe, a number of waste ranks (the term waste rank being used herein to refer to a knit course destined to be removed from the knitted article) of a so-called "unthreading" edge (the term unthreading edge being used herein to refer to an edge formed by a number of knit courses destined to be removed from the knitted article) is formed, usually of a single fabric one centimeter high, to avoid ladders during the seaming. According to the type of machine being used, the socks are produced:

a)one after the other. In this case the last rank (last knit course) of the unthreading edge is connected to the first rank of the elastic hem of the next sock through a resistant, smooth and well visible thread, which is worked with a feeding unit other than that for the elastic hem, and is to be manually removed to separate one sock from the other prior to the seaming of the toe;

b) detached from one another. This procedure is used mostly in the single- or two-cylinder circular machines provided with an automatic device for the separation of the manufactured socks.

Afterwards, each sock is to be overturned inside out to allow for seaming on the reverse side of the sock. Then, the toe is closed by removing the waste edge and sewing the last stitches of the last semirank of the back of the foot, together with those of the last rank of the sole of the foot.

However, performing the sewing of the toe of the socks outside the machine which makes them involves increase of time and cost production, mainly as a consequence of the numerous intermediate operations to be carried out between the knitting and the toe seaming, such as the removal and transfer of the socks towards the relevant stocking stores, and the classification thereof on a colour and/or size basis. All this implies, in fact, employing skilled personnel for carrying out and supervising these operations, and the provision of sufficiently wide spaces for siting the machines and for classifying and storing the socks. Moreover, in case of a large number of thus formed socks, the amount of yarn which is lost for the manufacturing of the socks and the subsequent removal of the waste edge, results significantly high and, therefore, the relevant cost will heavily and negatively affect the economic efficiency of the traditional manufacturing plants.

Also known, from document IT 9590-A/87, is a method for the formation of the closed toe of the socks during their manufacturing by a circular machine, including starting the sock with the formation of a tridimensional knit pocket corresponding to the toe. The pocket is formed with double fabric in which two equal edges are united in juxtaposition; proceeding with the formation of the sock foot after having put at work the needles previously made inoperative during the formation of the pocket, so as to hook it up. The above mentioned document also discloses an apparatus for carrying out the method, and with sinkers of half the cylinder of the thus-made-inoperative needles being provided with a crook for engaging the corresponding opposite needle as it is lifted up. A cam acts on the heel of the sinkers, which causes them to be displaced radially to move the head of the relevant opposite needle out of the cylinder. A wheel is provided revolving within the recess of the sinkers, to allow the first semirank of the pocket to be linked to move close to the stitchless needles.

However, this known apparatus does not always ensure that all the needles put at work will engage properly the yarn and, besides, as the linking goes on, that is, as the pocket grows smaller, it does not ensure an equal and uniform knitting.

Also known from the document IT 9465-A/90, is a method to hook-up the toe of the socks by means of the circular machine producing them starting frown the toe. According to this method provision is made for progressively pulling outwards, by a horizontal and gradually decreasing movement, a limited portion of the free semirank of the pocket to be linked, and holding this portion in proximity of the relevant stitchless needles. This is achieved by using the tip of a spring pressing from the inside of the needles cylinder onto the center of the first free semirank of the pocket, in cooperation with two hooks, one being provided with reciprocating horizontal motion and with alternate evolution at the end of every travel, and having the function of progressively linking the region to be linked of the semirank and pulling the latter towards and beyond the needles cylinder. The other is provided with reciprocating vertical motion to retain the semirank region thus treated by the first hook and allow for the link thereof by means of the stitchless needles put at work again.

However, experience has showed that this known working technique does not offer appreciable advantages, both in relation to the quality of the finished product, and to the machine productivity and reliability, and is unable to achieve a sock with rib-stitch elastic hem and unthreading on the inside thereof.

SUMMARY AND OBJECT OF THE PRESENT INVENTION

The main object of the present invention is to overcome the above mentioned drawbacks.

This result has been achieved, according to the invention, by adopting an operating method comprising the step of making a knitted tubular article starting from the elastic hem and finishing at the side of the toe which is left open, by using a single-cylinder circular machine, which method includes:

lifting a predetermined number of needles of a first semirank, while retaining the relevant stitches by means of the sinkers: the term semirank referring to a plurality of adjacent stitches;

lifting the needles of the first semirank to a greater extent, with the sinkers being open, to dispose the corresponding stitches at a height allowing for its removal afterwards;

lifting a predetermined number of needles of the second semirank by moving the stitches to the same level as the first semirank;

removing the stitches from the semirank by using means intended to transfer the second semirank onto corresponding needles;

lowering the needles of the first semirank;

transferring the thus removed stitches through a 180° overturning about a horizontal diametral axis of the needles cylinder, so that each stitch thus overturned will fit the relevant needle of the second semirank;

lifting the needles of the second semirank so as to load the transferred stitches of the first semirank and release them from the relevant transfer means;

placing the pairs of superimposed stitches of each needle of the second semirank closely juxtaposed and coaxial, so as to result suitable for their linking;

lifting further the needles of the second semirank with the stitches thus juxtaposed; rotating the needles cylinder with intermittent motion and inserting, step by step, a linking needle into a pair of thus lifted stitches by feeding it, without solution of continuity, with the thread used for the knitting of the article, and then removing it to form a linking plain chain-stitch; making two or more closing knots after having executed the last link stitch, that is, after the union of the two corresponding last stitches of the first and second semirank; performing the cut of the knitting and hook-up thread;

lowering the needles of the second semirank down to its cast off position to unload the thus finished article.

As far as the apparatus for implementing the method is concerned, it comprises:

first cam means to drive the lifting and respectively lowering of a predetermined number of needles of a first and a second semiranks of stitches, the needles being in operative condition when the knitting cams are inoperative, and vice versa;

second cam means to drive the further lifting and respectively lowering of the predetermined number of first and second semiranks, which needles are in operative condition when the knitting cams are inoperative, and vice versa;

means to remove the stitches of the first semirank and overturn them through 180° about a horizontal diametral axis of the needles cylinder, with a pair of spikes for each stitch and at least a corresponding opening and respectively closing peg, which are slidingly housed within corresponding slots of a semicircular sector pivotally mounted for a 180° angular displacement in both directions about a horizontal diametral axis of the needles cylinder on top of the sinkers of the circular machine;

means for connecting the semicircular sector to the needles cylinder, with a radial shutter sliding between two positions, one for locking the sector to the needles cylinder, and the other for releasing it therefrom, the positions being spaced apart by a constant and preset length;

fork means to lock the sinkers case during the horizontal rotation of the semicircular sector together with the needles cylinder, which fork means are activated by corresponding cam means connected to the support of the semicircular sector;

means to link the paired and superimposed stitches being loaded on the needles of the second semirank, with a crook-shape linking needle, with a crochet to operate the needle located on the side opposite with respect to the stitches, and with a wheel or slide pressing down the fabric to keep the stitches in a linking attitude during the linking. The wheel or slide being located on the linking needle by the same side as the knitting needles.

The advantages deriving from the present invention lie essentially in that the following are possible. It is possible to carry out the seaming of the toe of a knitted tubular article on the same machine producing it. This achieves a significant reduction in the time and cost of production, owing to the fact that some steps of the traditional toe seaming procedure of knitted tubular articles are completely eliminated. The eliminated steps include the unthreading operation and consequent formation of waste material, the transfer of articles from the circular machine to the stocking stores or to the sewing and linking machines, the overturning of the articles, the seaming of the toe and the subsequent turning right-side out of the same articles. It is possible to carry out the linking operation with the same thread used to form the last ranks of stitches, without loss of continuity, that is, without interrupting the article manufacturing cycle. It is possible to operate the linking with any stitch suitable for making knit articles such as the "chain-stitch", which has an excellent elastic behavior and can make use of most of the yarn available on the market. It is possible to close the toe of a sock in various forms, such as the so-called "fish mouth" seam and the "shark mouth" one, in addition to those of traditional type. It is possible to obtain the link either on the back or the bottom of the sock foot by simply knitting a pocket, before seaming the toe, on either side of the article opposite to the heel. It is possible to obtain a finished product of high quality as far as its appearance and function are concerned, inasmuch as the seaming line is knitted and unites the two toe edges without any increase in thickness. It is possible to provide an apparatus according to the invention of high reliability even after a prolonged use thereof. It is possible to provide a traditional circular machine without drastically reducing its functional structure.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DETAILED DESCRIPTION OF THE PREFERRED EMBODIMENT

Figure 17:
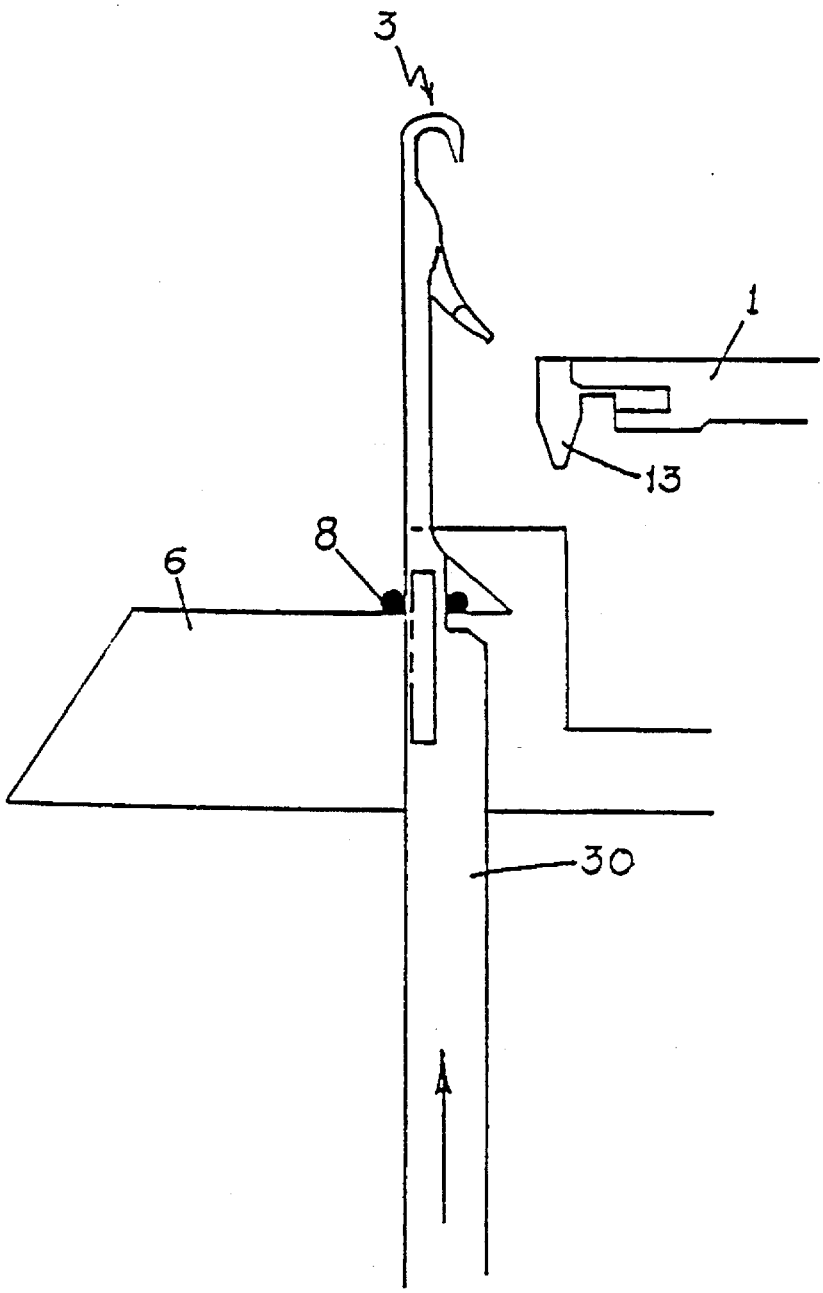
FIG. 17 shows the needle of FIG. 16 in the initial lift step.
Figure 29:
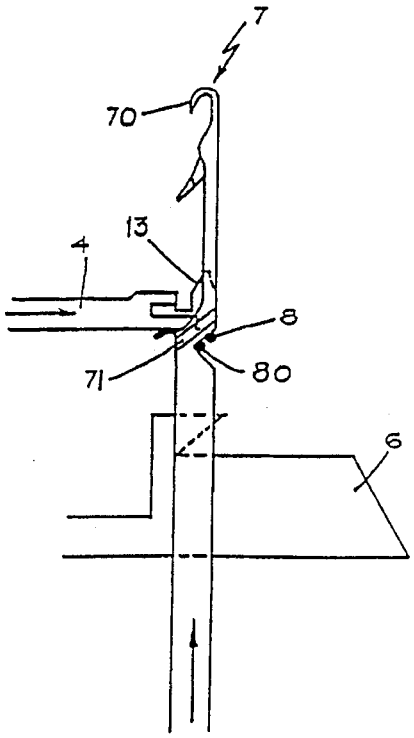
FIG. 29 shows the needle of FIG. 28 during the step of presetting the stitches for linking.
Figure 30:
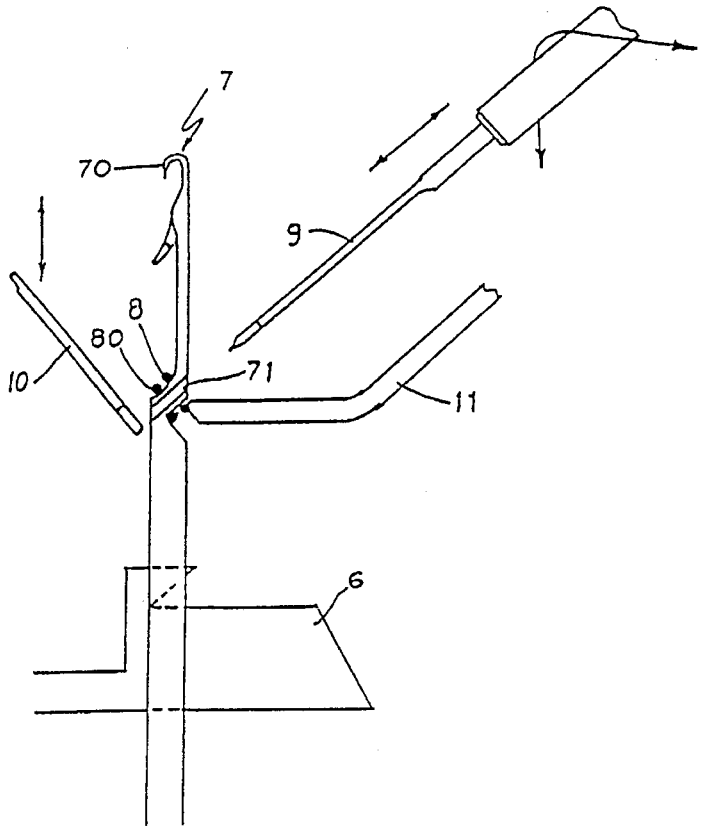
FIG. 30 shows the needle of FIG. 29 in the condition corresponding to the linking of the stitches fitted thereon, with the linking needle, the relevant crochet and the fabric-holding slide.

Reduced to its basic structure and reference being made to FIGS. 16–30 of the attached drawings, a method for seaming two edges of a knitted tubular article, especially a sock, comprises the steps of manufacturing the article with a single-cylinder circular machine, starting from the elastichem and finishing at the side of the toe which is left open, comprises in sequence, according to the invention, the following operative steps:

(a) lifting a predetermined number of needles (3) of a first semirank, by holding the relevant stitches by means of sinkers (6) as far as the removal region (31) (FIG. 17);

(b) lifting further up the needles (3) (FIG. 18) of the semirank, with the sinkers (6) open, to dispose the relevant stitches (8) to a level suitable for the removal thereof (a removal level);

(c) lifting a predetermined number of needles (7) together with the stitches (80) (FIG. 19) of the second semirank by moving them to the same level as the first semirank;

(d) removing the stitches (8) of the semirank by the means (4,13) provided for the transfer thereof onto corresponding needles (7) of the other semirank;

(e) lowering the needles (3) of the first semirank;

(f) transferring the thus removed stitches (8) through a 180° (FIG. 24) overturning about an horizontal diametral axis of the needles cylinder (1), so that each (8) stitch thus transferred will fit the relevant needle (7) of the second semirank;

(g) lifting the needles (7) of the second semirank (FIG. 25) so as to load the transferred stitches (8) of the first semirank and release them from the relevant transfer means (4,13);

(h) placing the pairs of superimposed stitches (8, 80) of each needle (7) of the second semirank tightly juxtaposed and coaxial, so as to result suitable for the linking thereof;

(i) lifting further the needles (7) of the second semirank with the stitches (8, 80) thus juxtaposed (FIG. 29);

(l) rotating the needles cylinder (1) with intermittent motion and inserting, step by step, a linking needle (9) (see FIG. 30) into a pair of thus lifted stitches by feeding it, without loss of continuity, with the thread (F) (see FIGS. 5A–5E) used for the knitting of the article and then removing it to form a plain link chain-stitch;

(m) making two or more closing knots (I, II) after occurring the last linking stitch;

(n) performing the cut of thread (F);

(o) lowering the needles (7) of the second semirank down to its cast off position to unload the thus finished article.

Advantageously, according to the invention, the step (c) may be carried out as the first one, and the steps (a) and (b) as second and respectively third one.

Likewise, advantageously, the steps (c) and (b) may be carried out as second and third one respectively.

Moreover, during the step (1) the cylinder (1) of needles (3, 7) is able to rotate uniformly and the linking needle (9), in this case, is inserted into the pair of stitches (8, 80) by causing it to follow the movement of the needles cylinder and move back out thereof to its initial position.

Figure 31:
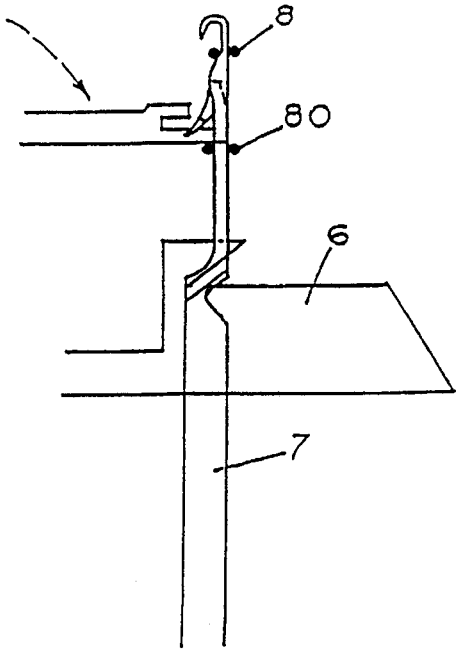
FIG. 31 shows the needle of FIG. 11 during the lift step for unloading the relevant stitch of the second rank from the tongue, according to an alternative embodiment of the invention.
Figure 32:
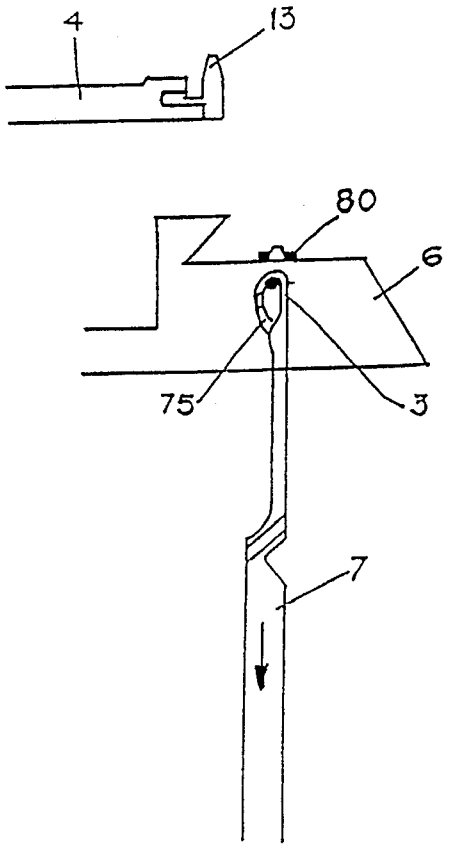
FIG. 32 shows the needle of FIG. 31 during the step of cast off of the transferred stitch and of unloading of the stitch located therebelow.
Figure 33:
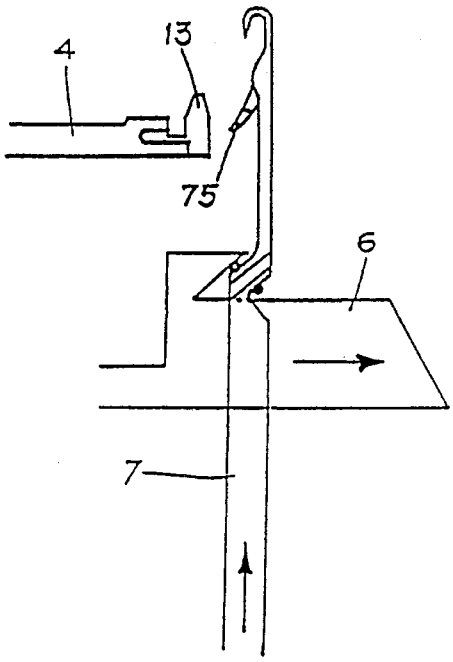
FIG. 33 shows the needle of FIG. 32 in the lifting step, with closed sinkers, to place the relevant transferred stitch in a linking attitude.
Figure 34:
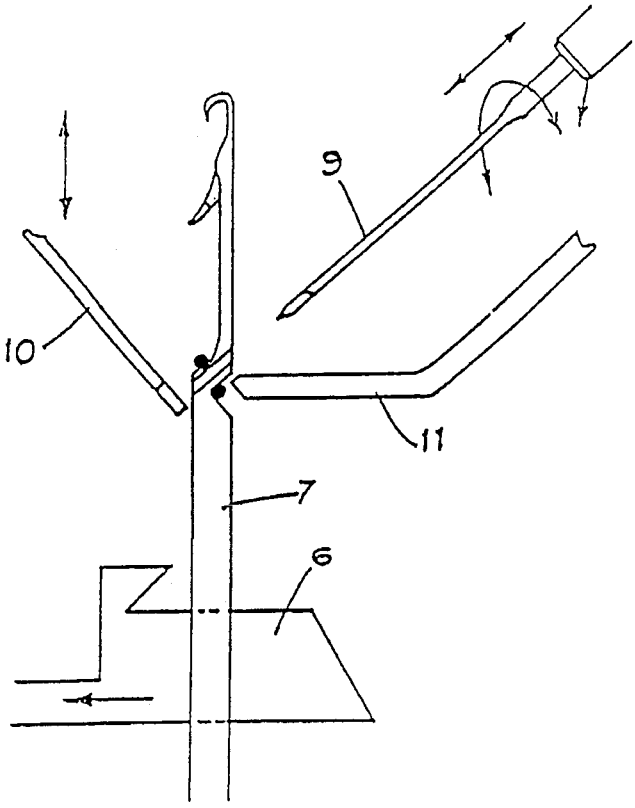
FIG. 34 shows the needle of FIG. 33 in the position of lift end to place the relevant stitch in a linking attitude.

Alternatively, and with reference to FIGS. 31–32 of the drawings, after the step (g) for the release of the transferred stitches (8), and in place of the successive steps, provision is made for:

(h') lifting the needles (7) (FIG. 31) of the second semirank up to the level of the unloading of the relevant stitches (80);

(i') lowering the needles (7) (FIG. 32) of the second semirank, with the sinkers (6) being open, until the relevant transferred upper stitches (8) are in the cast off condition;

(l') lifting the needles (7) (FIG. 33), with the sinkers (6) being closed, so as to dispose the relevant stitches (8) in an attitude suitable for linking (a linking altitude);

(m') lifting further the needles (7) (FIG. 34), with the sinkers (6) being open, so as to dispose the corresponding stitches (8) at a level suitable for the linking operation;

(n') rotating the cylinder (1) of needles (3, 7) with intermittent motion and inserting, step by step, a linking needle (9) into each thus disposed stitch (8) by feeding the needle, without loss of continuity, with the thread (F) used for the knitting of the article and then removing it to form a plain linking chain-stitch;

(o') making two or more closing knots (I, II) after having executed the last stitch;

(p') cutting the thread (F);

(q') lowering the needles (7) of the second semirank down to the cast off position to tinload the thus finished article.

Advantageously, according to the invention, during the step (n') the cylinder (1) of needles (3, 7) is able to rotate uniformly and, in this case, the needle (9) goes through the stitch (8) by following the movement of the cylinder (1) and then comes back to leave the cylinder (1) of needles (3, 7) and resume its initial position.

As far as the apparatus for implementing the method is concerned, according to the invention and with reference, to the attached drawings, it includes:

first cam means (2) for operating the lifting and respectively the lowering of a predetermined number of needles (3, 7) (see FIGS. 10A, 10B, 10C, 10D) of a first and a second semirank of stitches (8, 80), which are disposed in the operative condition when the knitting cams are inoperative, and vice versa;

second cam means, not shown for clarity, for operating the further lifting and respectively lowering of the predetermined number of needles (3, 7) of the first and second semiranks, which are disposed in operative condition when the knitting cams are inoperative, and vice versa;

means for removing the stitches (8) of the first semirank and overturn them through 180° about a horizontal diametral axis (a—a) of the cylinder (1) of needles (3, 7), with a pair of spikes (13) (see FIGS. 12A–12C) for each stitch (8) which are provided with a recess (130) located in proximity of the head being turned downwards in the removal condition, the recess (130) intended to receive and hold therein a relevant stitch (8), and with two corresponding opening and respectively closing peg (4) for each pair of spikes (13), which spikes (13) and respective pegs (14) are slidingly housed in corresponding slots of a semicircular sector (5) and so constructed as to be moved on both sides of sector (5) according to the overturning thereof: the sector (5) being rotatively mounted for a 180° angular displacement in both directions about a horizontal diametral axis (a—a) of the cylinder (1) of needles (3, 7) on top of sinkers (6);

means for connecting the sector (5) to the cylinder (1) of needles (3, 7), with a radial shutter (60) which, in operative mode, is engaged within a corresponding groove (61) of an element solid to the cylinder (1) of needles (3, 7) upon operation of a corresponding cam sliding between two positions, one for blocking the support of the sector (5) to the cylinder (1) of needles (3, 7) and the other for releasing it from same cylinder (1) of needles (3, 7) the positions being spaced apart by a constant and preset length;

means for blocking the sinkers case during the horizontal rotation of the sector (5) together with the needles cylinder (1), with two forks (62) supported on the stationary part of the machine and radially sliding with respect to the cylinder (1), which forks are associated with two corresponding vertical pins fixed to the sinkers case, and with a corresponding actuation cam (64) which is solid to the support of sector (5) so that, by the rotation thereof, at least one of the forks (52) with relevant pin will retain the sinkers case;

means for carrying out the linking of paired and superimposed stitches (8, 80) being fitted on the needles (7) of the second semirank, with a crookshaped linking needle (9) fixed at the front end of a rod driven into an alternate rotary motion about its axis and, respectively, into a reciprocating translatory motion along the axis, with a corresponding crochet (10) located on the side of the needle (9) opposite with respect to stitches (8, 80), and with a fabric-holding wheel or slide (11) to keep the stitches (8, 80) in linking position during the linking; the wheel or slide (11) being located on the same side of the linking needle (9) with respect to the knitting needles (3, 7).

Advantageously, according to the invention, the radial slots of the sector (5) are two-by-two parallel to each other, with each pair being oriented to a corresponding radius of sector (5) passing through the corresponding needle (3) and respectively (7). Moreover, advantageously, provision is made that the linking needle (9) be positioned rearwardly of the needles (7) of the second semirank.

Alternatively, the linking needle (9) may be positioned in front of the needles (7) of the second semirank.

LONGITUDINAL MOVEMENT OF NEEDLES (3, 7)

The needles (3, 7) are slidingly mounted onto the cylinder (1), as in all circular knitting machines. This is well known to those skilled in the art. Furthermore, these needles (3, 7) are provided with heels (33, 33' and 74, 74').

When the cylinder (1) rotates about its vertical axis, as the needles (3, 7) rotate about the same axis, as the needles (3, 7) connected to the cylinder to the cylinder (1). Due to this rotation of needles (3, 7) about the vertical axis of the cylinder (1) there is interaction—that is to say the contact between the heels of the needles and the lifting-lowering cam means. Due to this interaction the needles (3, 7) move along their longitudinal axis, that is to say the lifting-lowering of the needles (3, 7) takes place. This kind of structure is well known since it is commonly used to move the needles in the known circular knitting machines.

In other words, the movement of the needles (3, 7) along their own axis is obtained by means of the action exerted by the cam means on the heels of the needles when the needles rotate together with the cylinder.

According to the invention, the needle (9) may be driven into a horizontal reciprocating oscillation motion in association with the cylinder (1) of needles (3, 7) which rotates of continuous motion.

Advantageously, according to the invention, each of the spikes (13) is provided with two heels (131) protruding from opposite sides but vertically aligned to allow them to reciprocate inside the respective slots of the sector (5) by means of a corresponding horizontal fixed cam (14), to cause the displacement of spikes (13) in the two directions with respect to sector (5) and relative to the position thereof with respect to the needles cylinder (1).

Likewise, advantageously, each of the pegs (4) is provided with two heels (40) protruding from opposite sides and being vertically offset to be moved by the cam (14). Moreover, advantageously, the spikes (13) are provided with a head having wedge-like profile, in order to ease the capture and respectively the release of the corresponding stitches (8) to be transferred.

MOVEMENT OF SPIKES (13) AND PEGS (4)

As described above, the spikes (13) and the pegs (4) are slidingly located in pairs—in corresponding slots of the sector (5). The sector (5) can be connected to the cylinder (1) by means of the shutter (60) which is engagable with a groove (61) of an element connected to the cylinder (1).

When the sector (5) is connected to the cylinder (1), the sector (5) rotates with the cylinder (1). Due to the rotation of the sector (5) the fixed cam (14) acts on the heel (131) of the spikes (13) and the heel (40) of the pegs (4). This action of the cam (14) is cause for the sliding of the spikes (13) and the pegs (40). (The cam 14 and the heels 131 and 40 are described on page 26 of the originally filed description). In other words, the fixed cam (14) acts on the heel of the spikes (13) and pegs (4) when the latters housed in the sector—rotate about the vertical axis of the cylinder, so that under the action of the cam (14) the spikes (13) and pegs (4) move along the corresponding slots of the sector (5). The movement of the spikes (13) and pegs (4) within the relevant slots of the sector (5) is cause for the capture of the stitches to be transferred as described herein and shown in FIGS. 20, 21 and 22.

According to the invention, the heels (131, 40) of spikes (13) and pegs (4) have a height chosen in relation to the profile of the corresponding driving cam (14).

Figure 1:
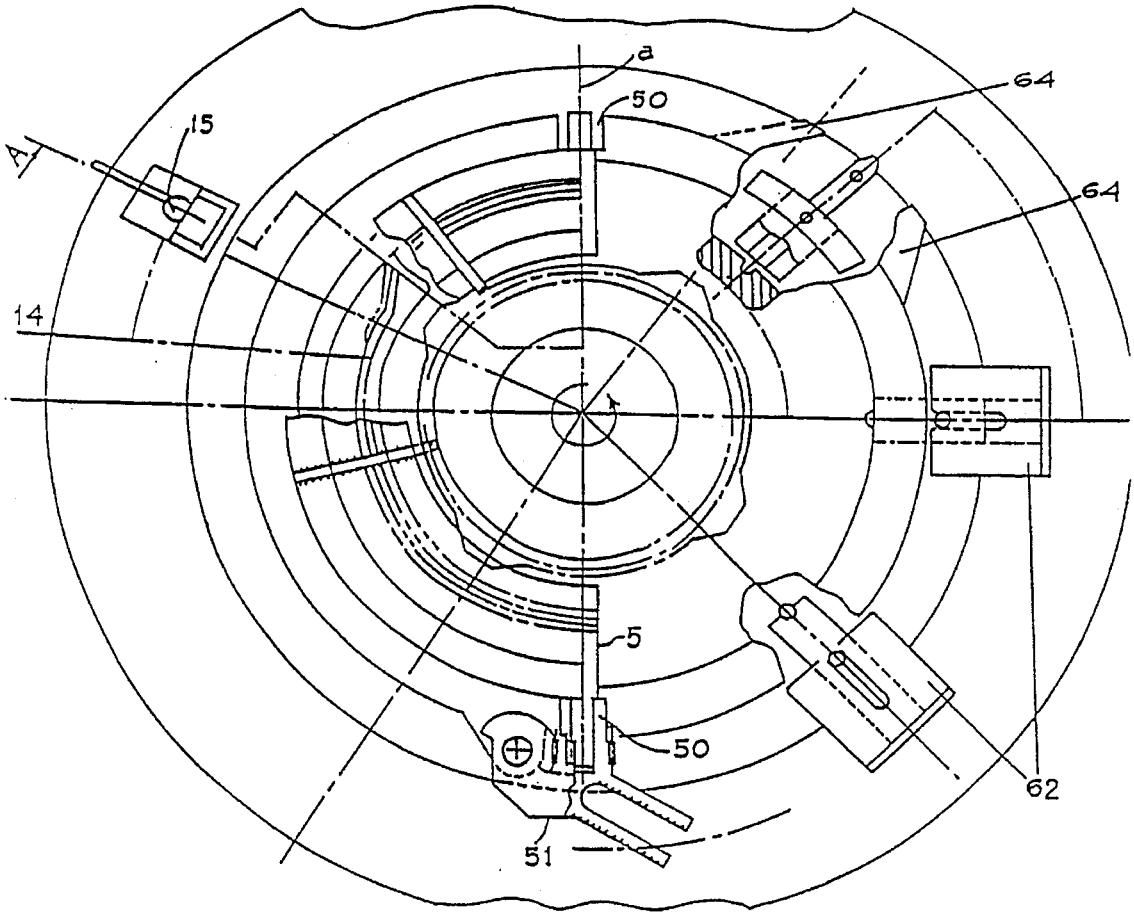
FIG. 1 is a plan view partly in section of a circular machine provided with an apparatus according to the invention.
Figure 2:
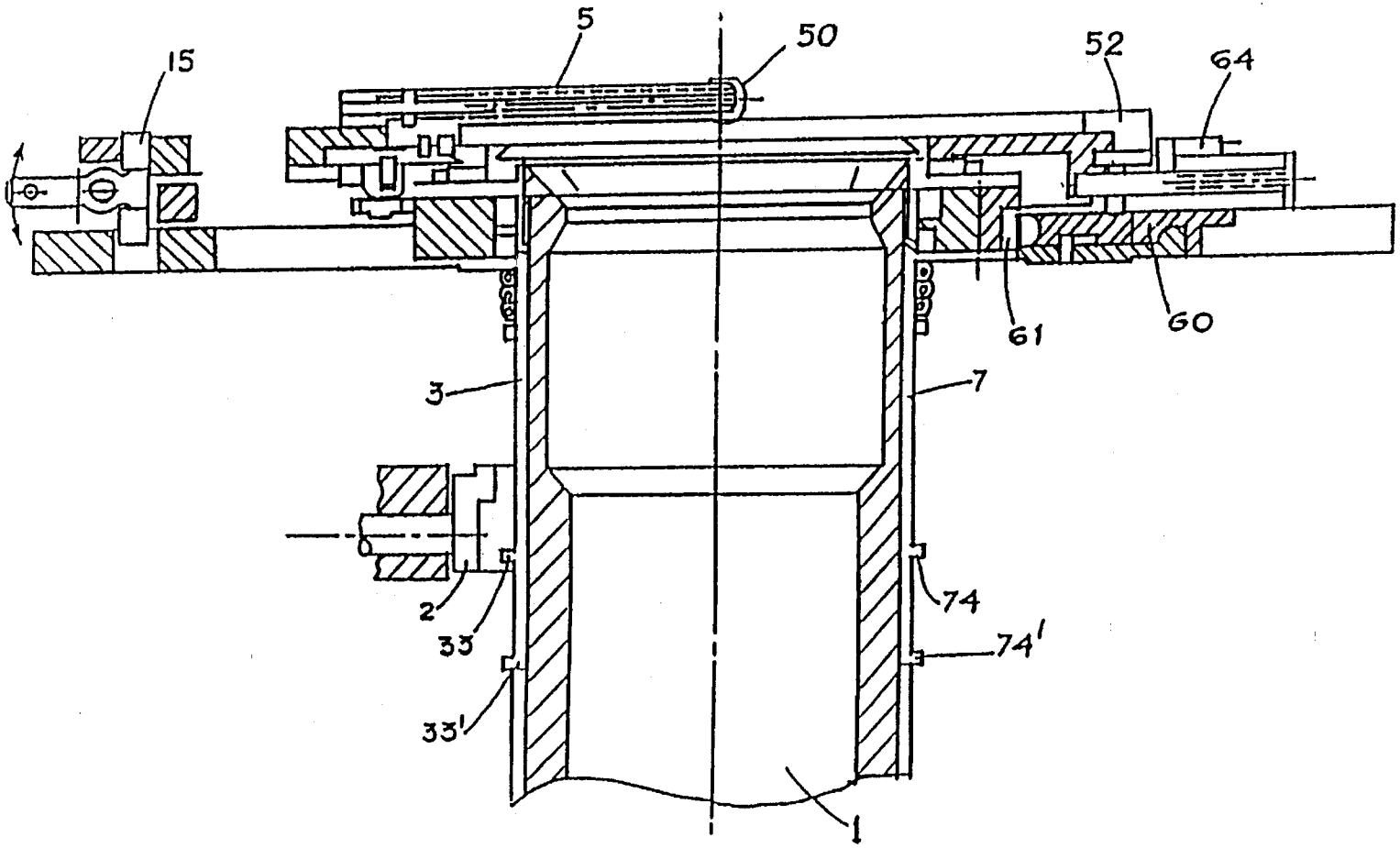
FIG. 2 is a sectional view on line A—A of the machine in FIG. 1.

According to the invention and reference being made to FIGS. 1 and 2 of the drawings, the oscillating sector (5) is idly mounted on two corresponding cylindrical hinges (50) horizontally coaxial and diametrically opposite to each other, which are fixed on a circular ring (53) coaxial to the needles cylinder (1), the sector being provided with a fork (51) to be engaged with a corresponding vertical operating peg (15) to drive it into alternate rotation with 180° angular displacement by means of a corresponding drive having skew axes: the vertical peg (15) vertically sliding between two positions, a lifted one to activate the horizontal rotation of the fork (51) and a lowered one of rest condition. The peg 15 as a vertical peg vertically slides between two positions. One of the positions (up) is a lifted position for activating a horizontal rotation of a fork (51). The other position (down) needs no actuation. The peg may be moved in a suitable way in order to obtain the actuation as desired. FIG. 2 shows a lever, where arrows depict movement of the lever. This lever in turn (double arrows of FIG. 2 near the lever connected to the peg 15) is movable. This lever may be moved by a relevant drive means can be proved without undue experimentation. The drive may be for example a cam or like, which is well known in this particular field (the general field of knitting in specific circular knitting machinery).

Figure 10A:
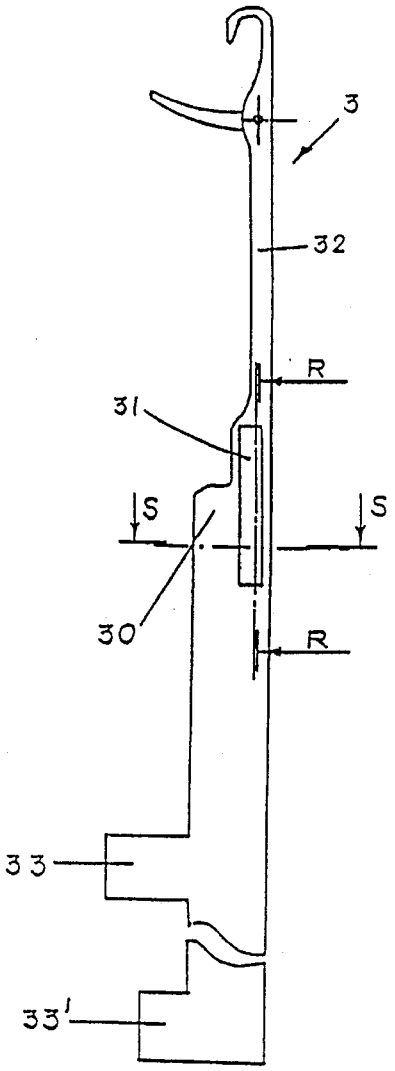
FIG. 10A is a side view of a needle for the stitches to be transferred.
Figure 10B:
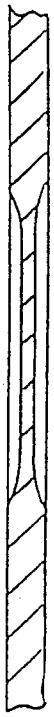
FIG. 10B is a sectional view taken on line R—R in FIG. 10A.
Figure 10C:
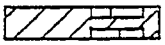
FIG. 10C is a sectional view taken on line S—S in FIG. 10A.

As shown in FIGS. 10A–10C of the drawings, the needles (3) of the first semirank are provided with a slot (31) in either sides thereof, to receive the head of the corresponding spikes (13) and allow the latter to be inserted into the corresponding stitches (8), and with a heel (33) supplementing the knitting heels (33'), which is to be activated by one of the cam means.

Figures 11A, 11B:
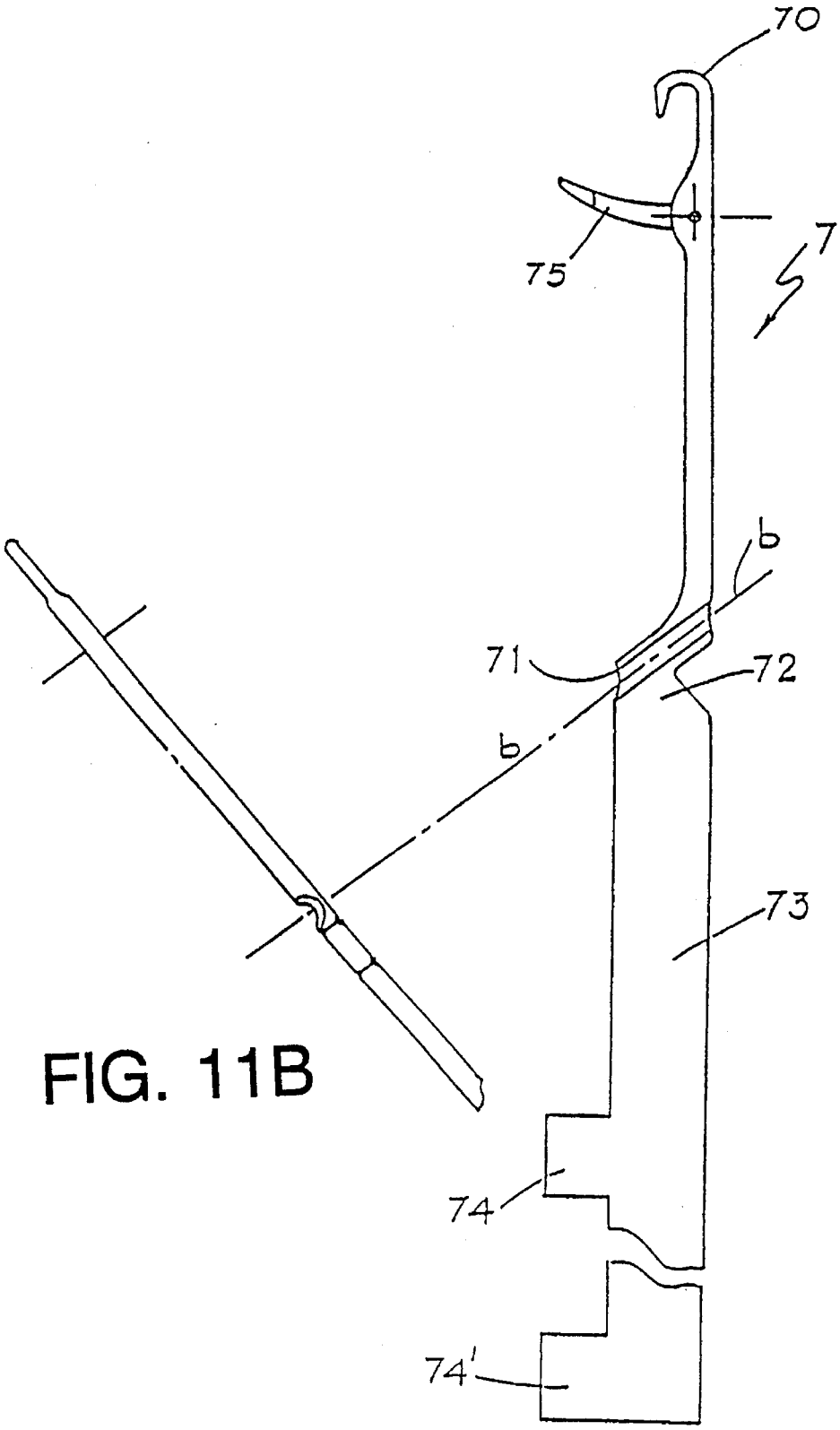
FIG. 11A is a side view of a stitch-supporting needle during the linking step.
FIG. 11B is a back view of the needle of FIG. 11A.

As shown in FIG. 11, the needles (7) of the second semirank are provided with a heel (74) supplementing the knitting heels (74'), which is activated by one of the cam means, and are also provided with a slot (71) having an axis (b—b) inclined downwardly with respect to the longitudinal axis of the stem (73) and centrifugally with respect to the cylinder (1) of needles (3, 7), which slot is formed in a same side for all the needles (7), and is intended to guide the linking needle (9).

Alternatively, the slot (71) of needles (7) has its axis inclined upwardly with respect to the longitudinal axis of stem (73) and centrifugally with respect to the cylinder (1) of needles (3, 7).

Advantageously, in certain circular machines, the heels (33, 73), supplemental to needles (3, 7), coincide with the knitting heels (331, 73').

Figure 12A:
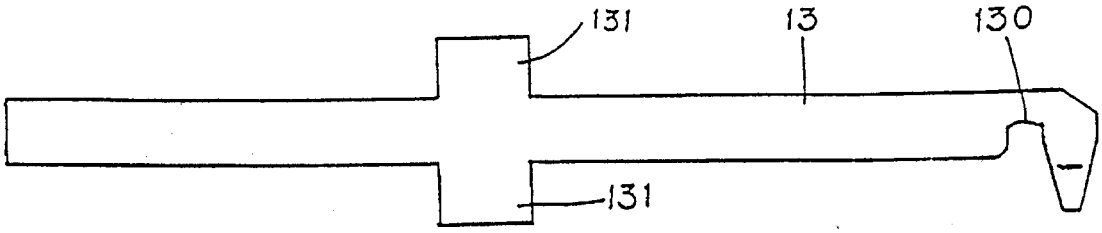
FIG. 12A is a side view of a spike for the removal and overturning of the stitches.
Figure 12B:
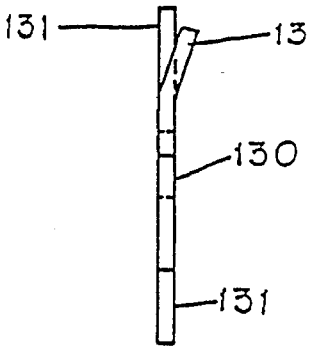
FIG. 12B is a front view of the spike of FIG. 12A, with the head turned to the right.
Figure 12C:
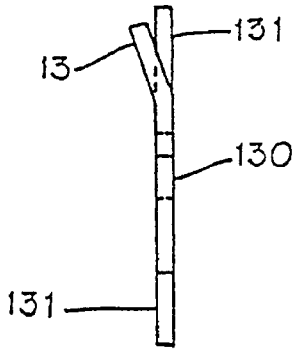
FIG. 12C is a front view of a spike likewise in FIG. 12A, with the head turned to the left.
Figure 13:
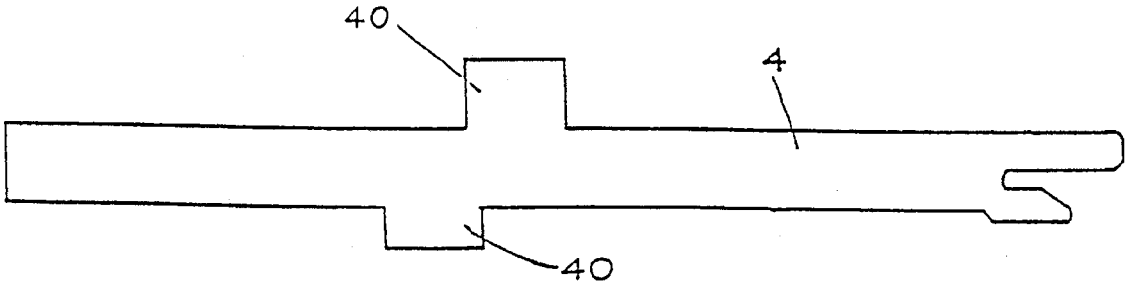
FIG. 13 is a side view of a peg for opening and respectively closing the stitch on the spike of FIG. 12A.

Also advantageously, reference being made to FIGS. 12A–12C, the spikes (13) are provided with a tip being bent in correspondence of the head, sideways and internally of the respective sliding direction, to allow for the insertion thereof into the recesses (31) of corresponding needles (3) of the first semirank and, thereby, ensuring the capture of the relevant stitches (8).

According to the invention, the method is carried out by means of a cylinder (1) of needles (3, 7) having either an odd or an even number of needles.

Figure 3A:
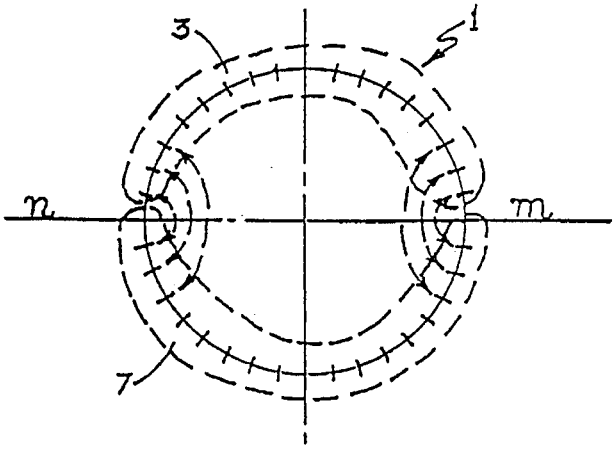
FIG. 3A is a schematic plan view of the needles cylinder of the machine of FIG. 1, according to a first embodiment, with an even number of needles, and wherein the linking line (n-m) is disposed in a diametral line joining two diametrically opposite needles.

In particular, with reference to FIG. 3A, provision is made for the axis (a—a) of rotation of sector (5) to coincide with two diametrically opposite needles and, accordingly, the withdrawn stitches (8) of the first rank are equal in number to the cylinder needles (3, 7) minus two, divided by two, which stitches being transferred onto as many needles (7) of the second semirank. In conclusion, the stitches (80) of the two needles (7) which result at the ends of the second semirank, and have been excluded by the procedure for the transfer of the stitches (8) of the first semirank, are likewise linked.

Figure 3B:
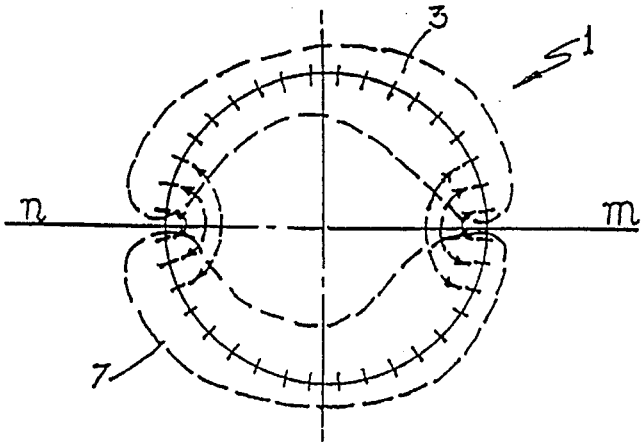
FIG. 3B is a schematic plan view of the needles cylinder of the machine of FIG. 1, according to a second embodiment, with an even number of needles, and wherein the linking line (nm) is made to pass through two diametrically opposite pairs of needles.

With reference to FIG. 3B, provision is made for the axis of rotation (a—a) of sector (5) to pass between two diametrically opposite pairs of needles (3, 7) of needles cylinder (1). In this way, the number of transferred stitches will result equal to half the total number of needles.

Figure 3C:
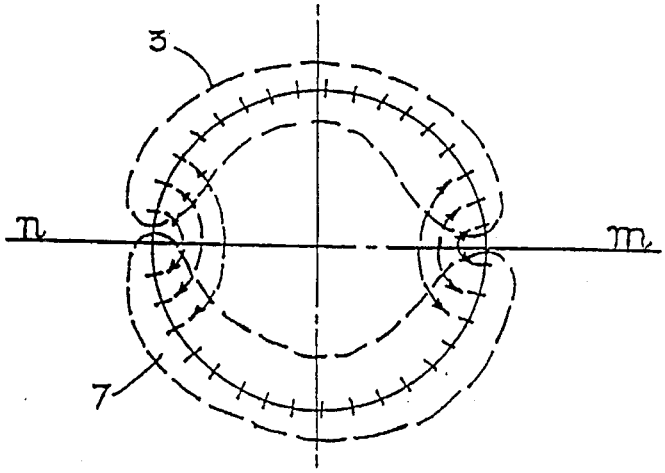
FIG. 3C is a schematic plan view of the needles cylinder of the machine of FIG. 1, according to a further embodiment, with an odd number of needles, wherein the linking line (n-m) joins a needle at the side N with the center of a pair of needles at the side M.
Figure 4A:
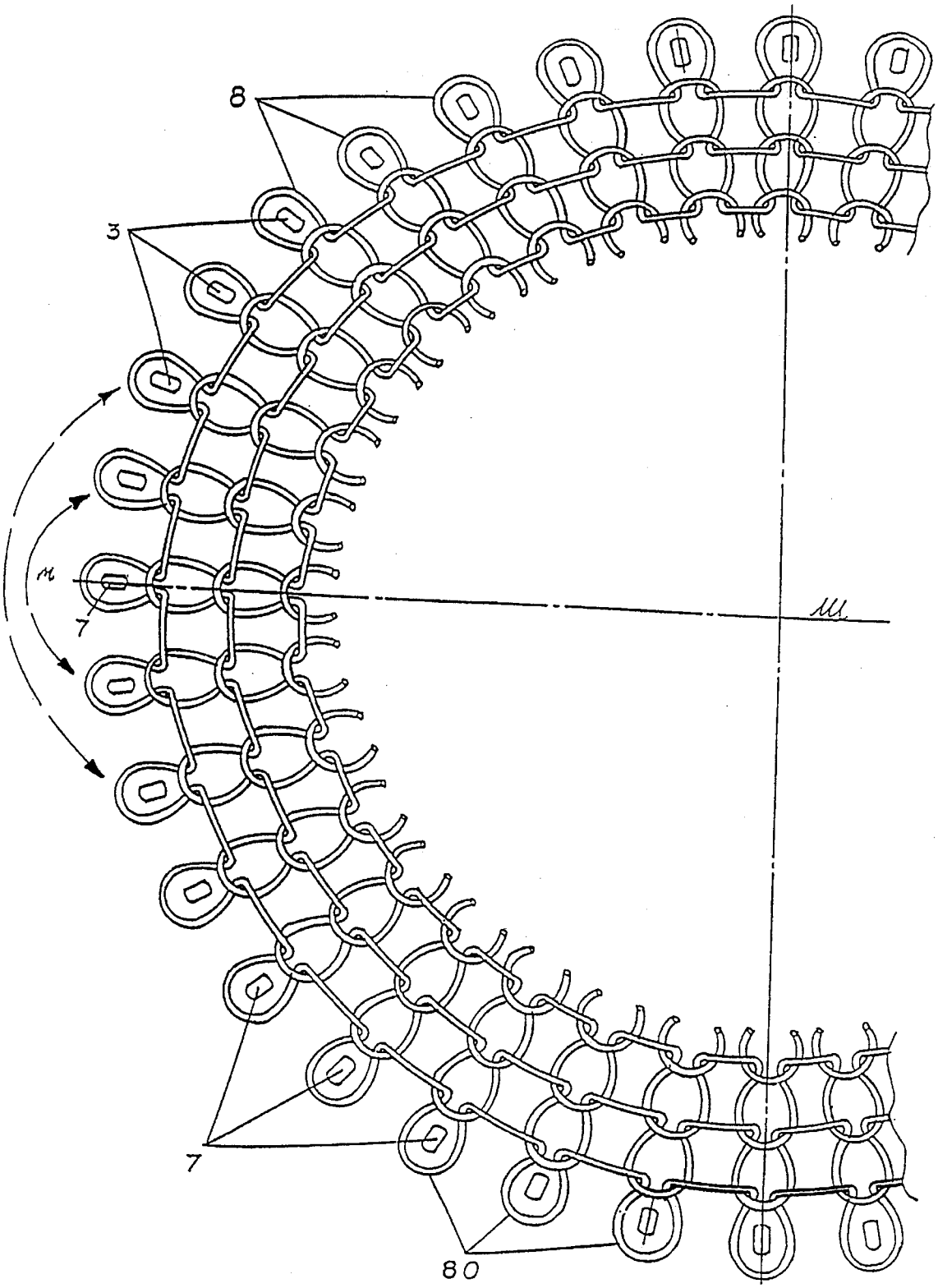
FIG. 4A is a partial plan view in enlarged detail of the last rank of stitches operated on the cylinder of FIGS. 3A or 3C at the side n prior to the linking.
Figure 4B:
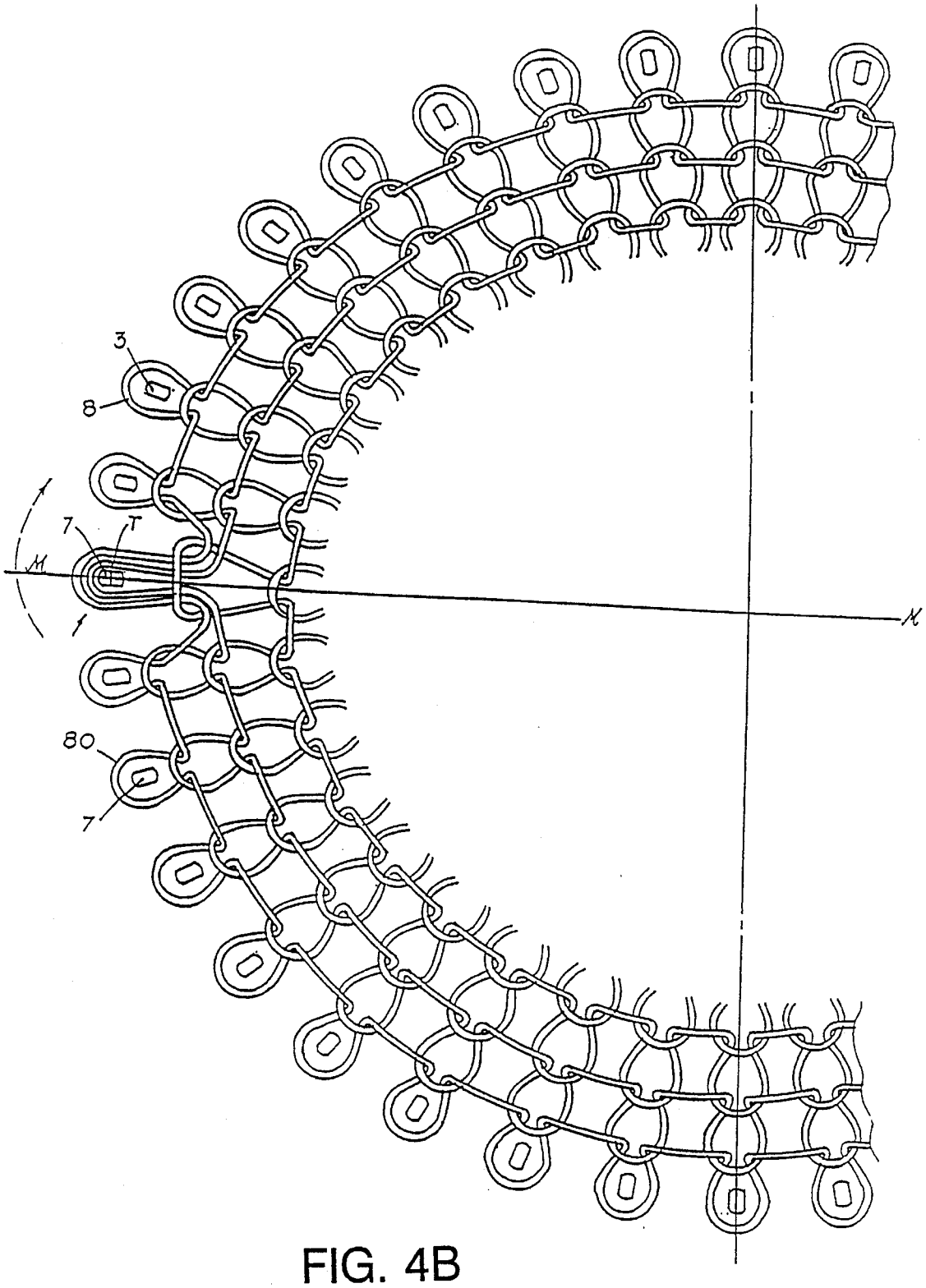
FIG. 4B is a partial plan view in enlarged detail of the last rank of stitches operated on the cylinder of FIGS. 3A or 3C at the side n, prior to the linking and with the last stitch (T) tucked loop-operated, that is, not discharged from the relevant forming needle.
Figure 4C:
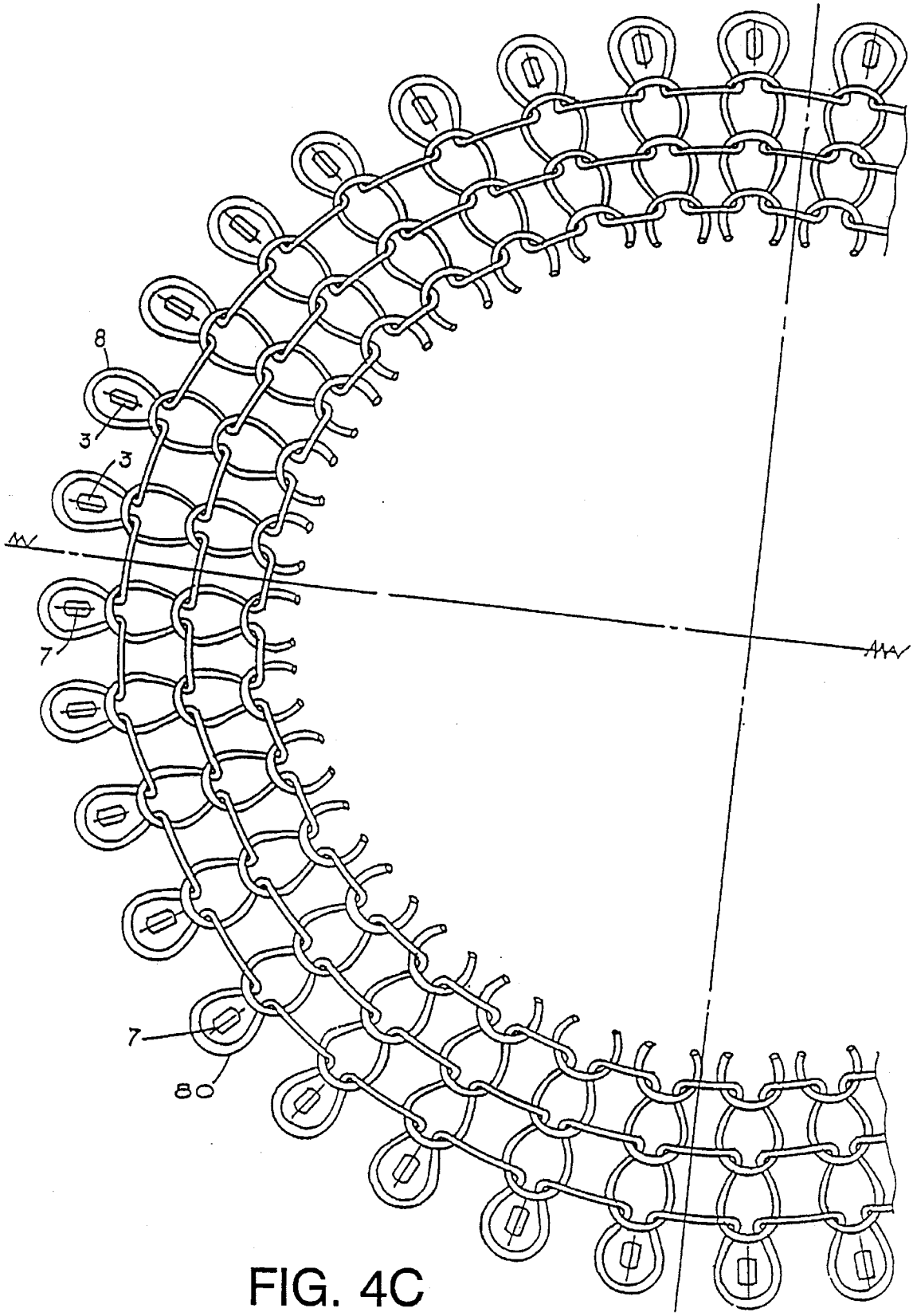
FIG. 4C is a partial plan view in enlarged detail of the last rank of stitches operated on the cylinder of FIGS. 3B or 3C at the side m, prior to the linking.
Figure 5A:
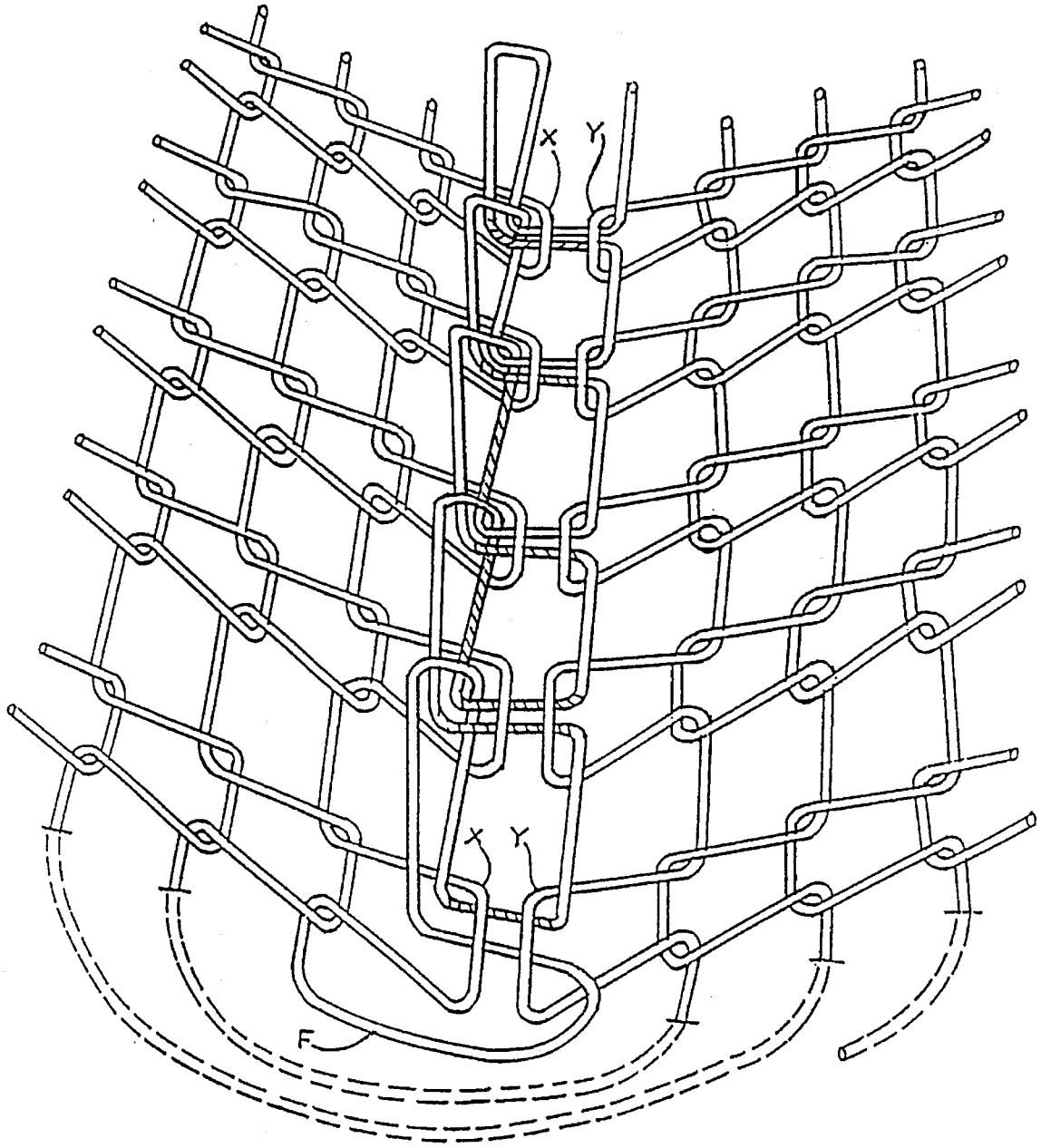
FIG. 5A is a plan view of the detail of FIG. 4C in the initial toe linking step, with the linking thread being picked up from the side (x) of the fabric.
Figure 5B:
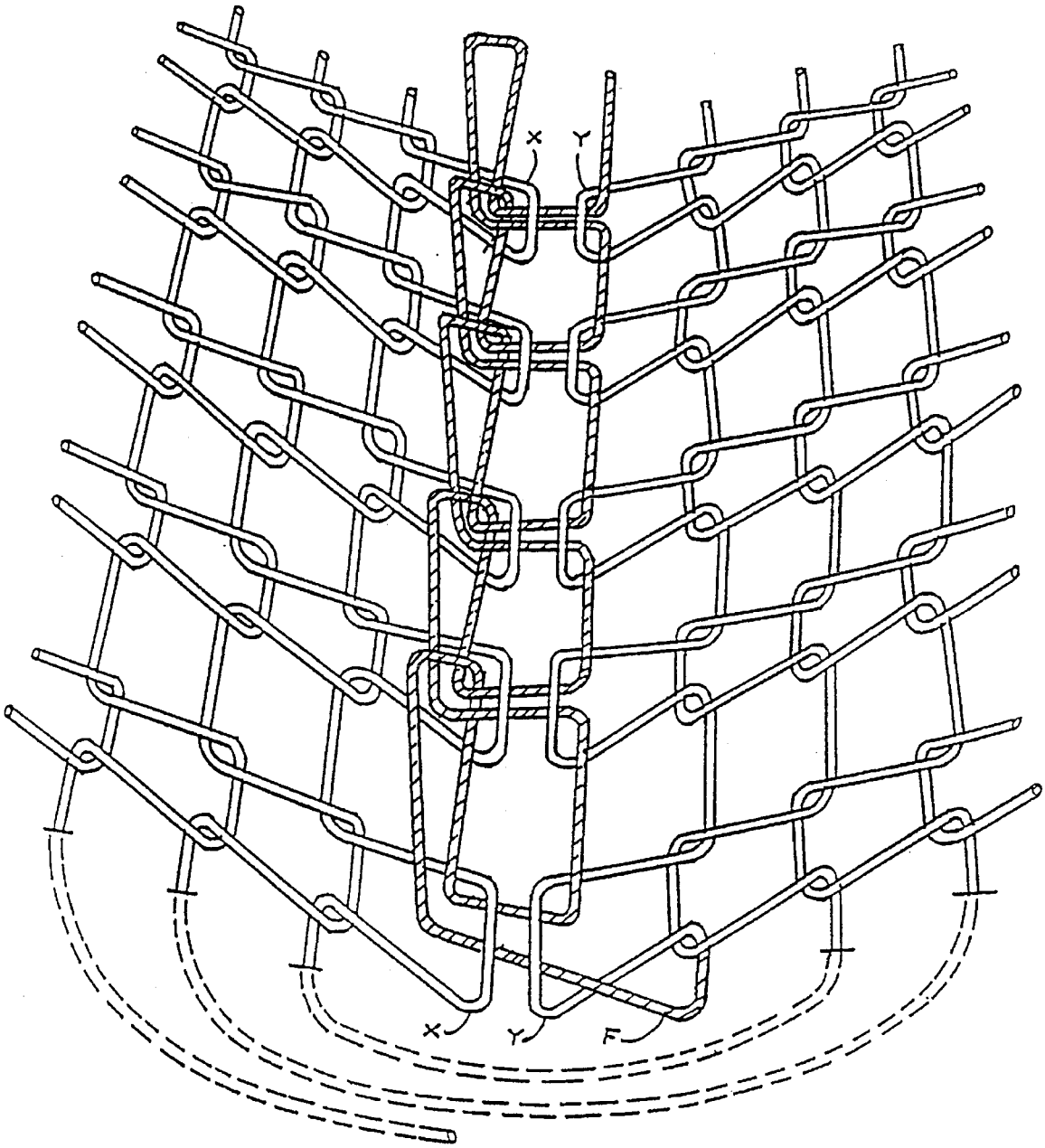
FIG. 5B is a detailed view showing the article of FIG. 4C in the initial toe linking step, with the linking thread being picked up form the side (y) of the fabric.
Figure 5C:
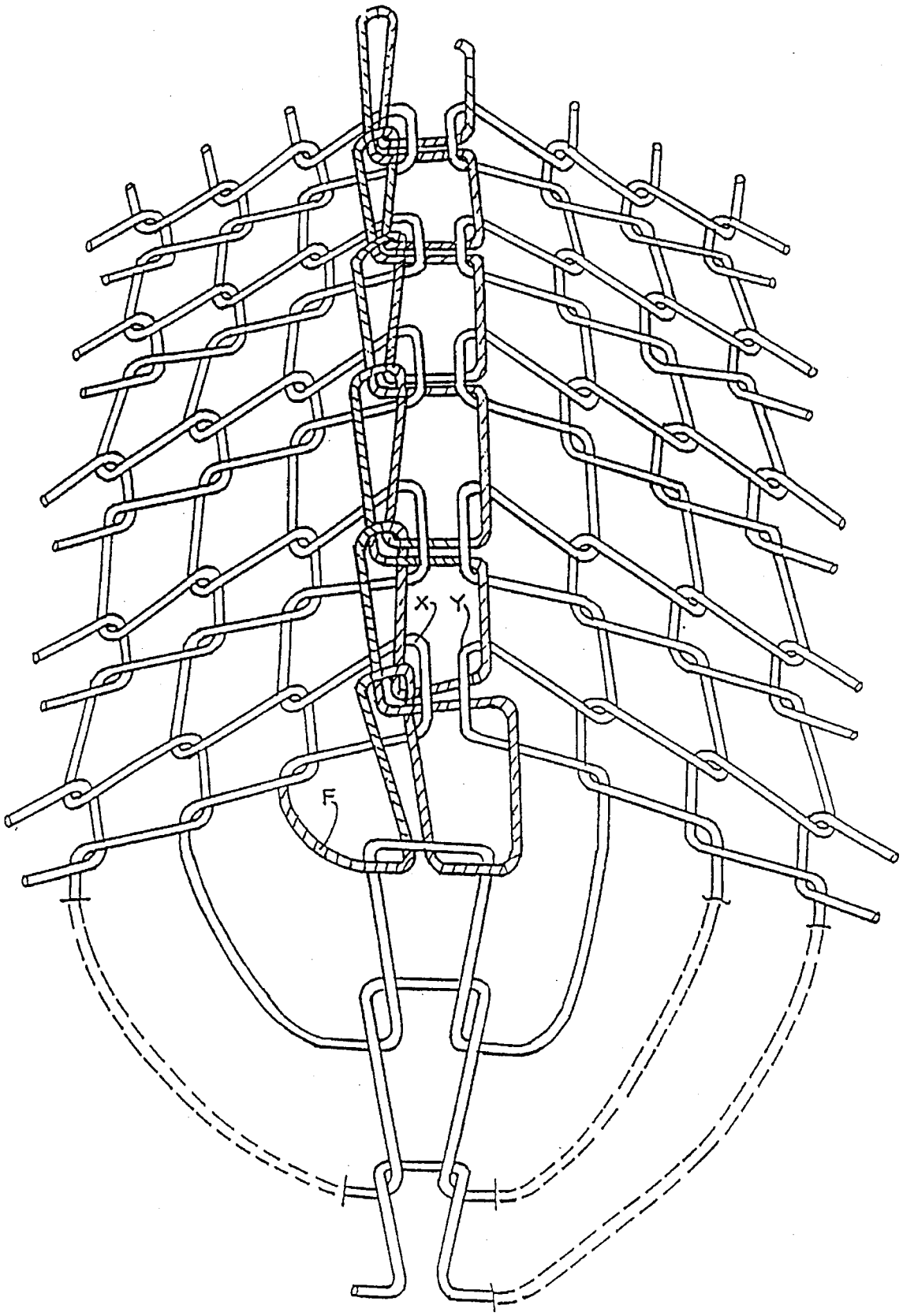
FIG. 5C is a detailed view showing the article of FIG. 4A during the initial toe linking step.
Figure 5D:
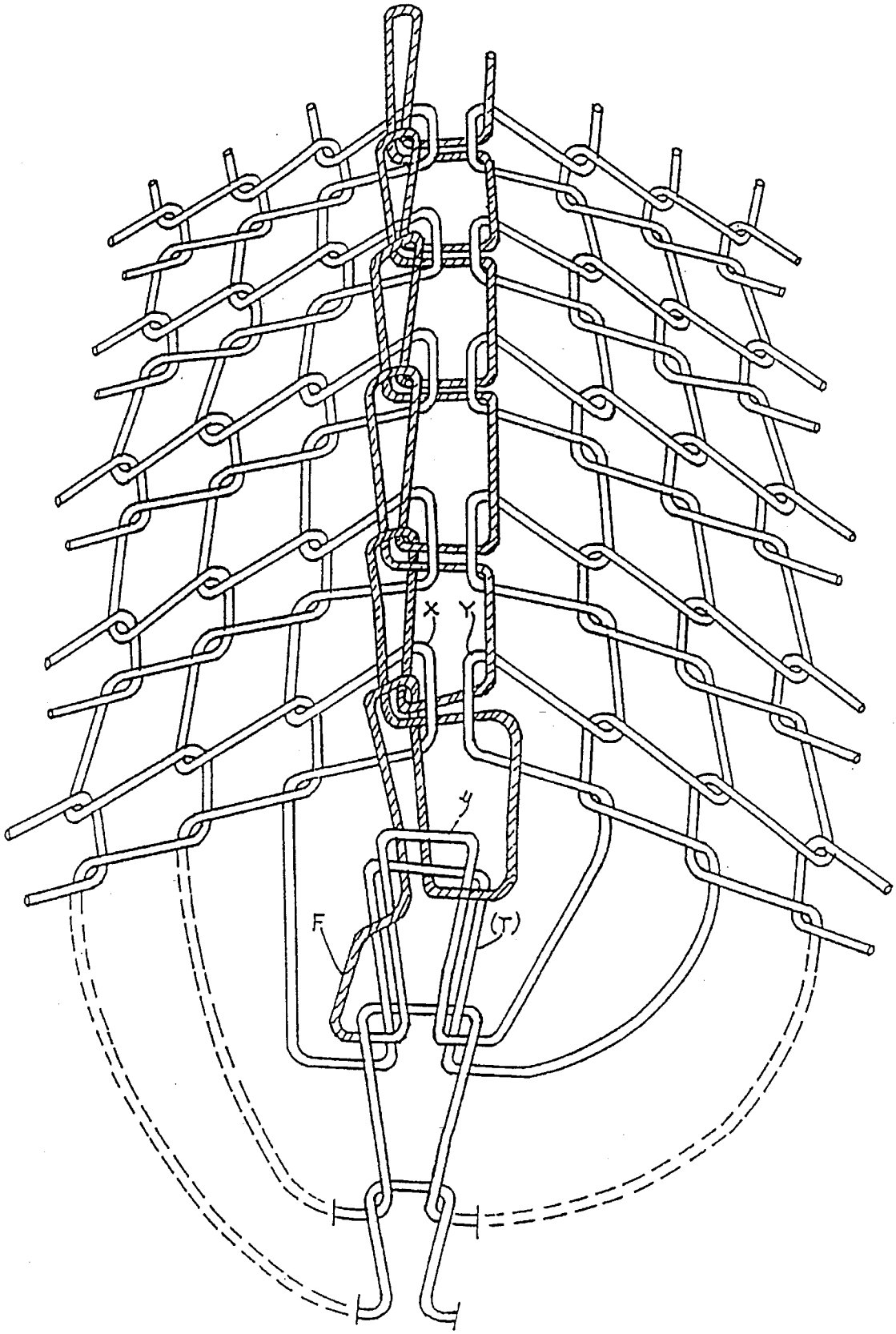
FIG. 5D is a detailed view showing the article of FIG. 4B during the initial toe linking step.
Figure 5E:
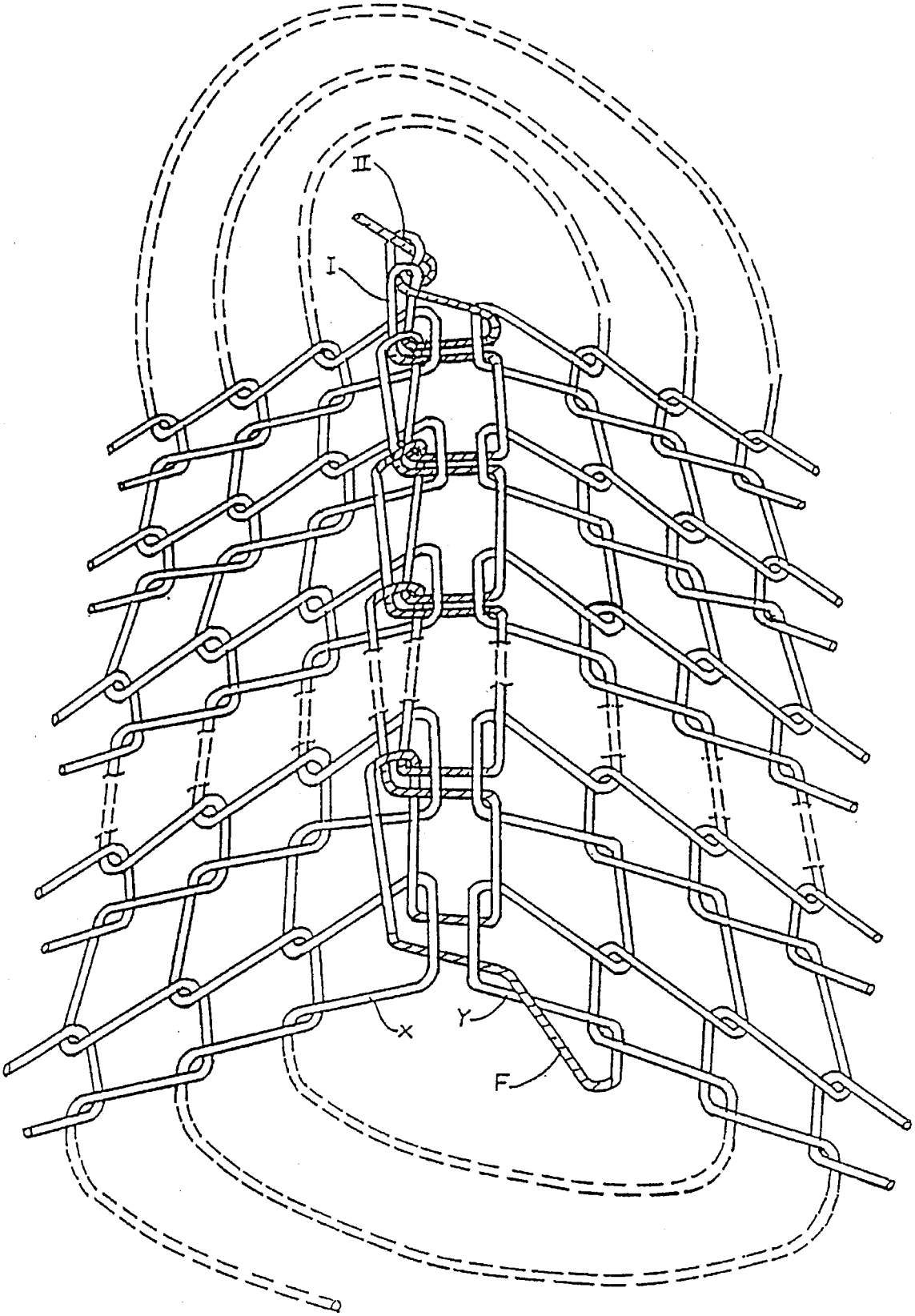
FIG. 5E is a detailed view showing a tubular article during the linking of the toe, with two end chain knots (I, II) to fix the linking thread.
Figure 6A:
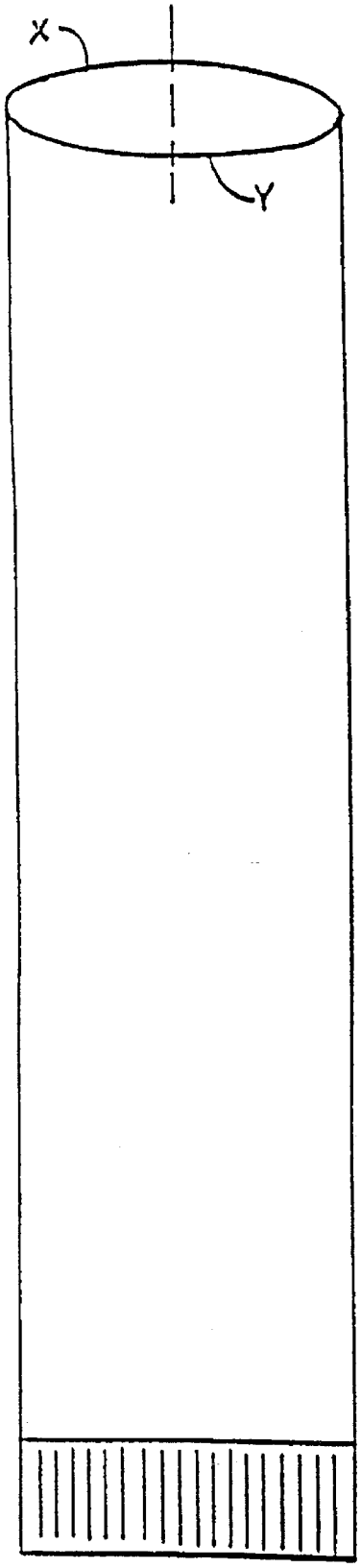
FIG. 6A. is a perspective view of a general tubular article with open toe.
Figure 6C:
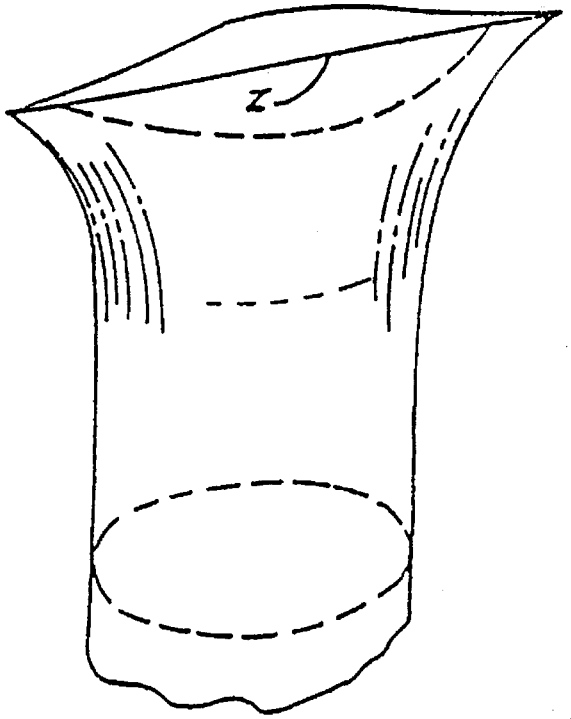
FIG. 6C is a schematic view of the article of FIG. 6A in the final toe seaming step.
Figure 6B:
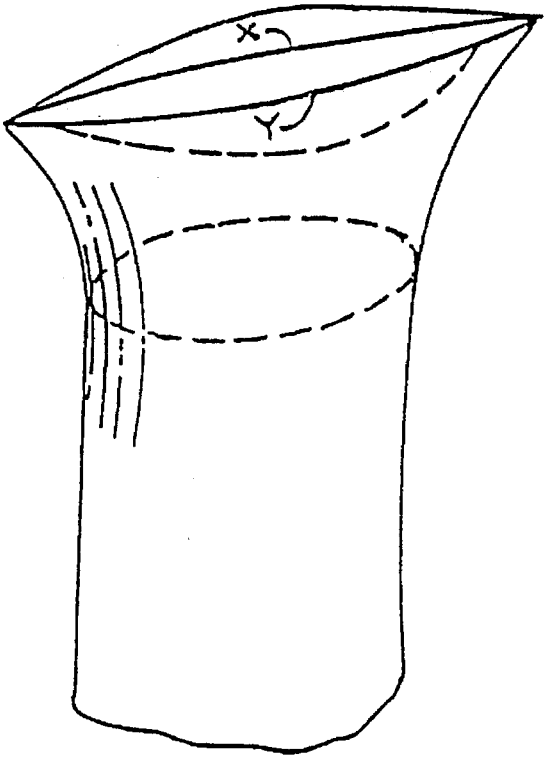
FIG. 6B is a schematic view of the article of FIG. 6A in the second-last step of toe seaming.
Figure 6D:
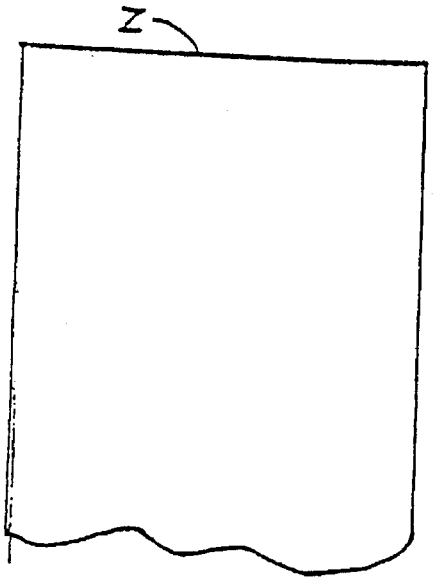
FIG. 6D is a view in longitudinal section of FIG. 6C.
Figure 7A:
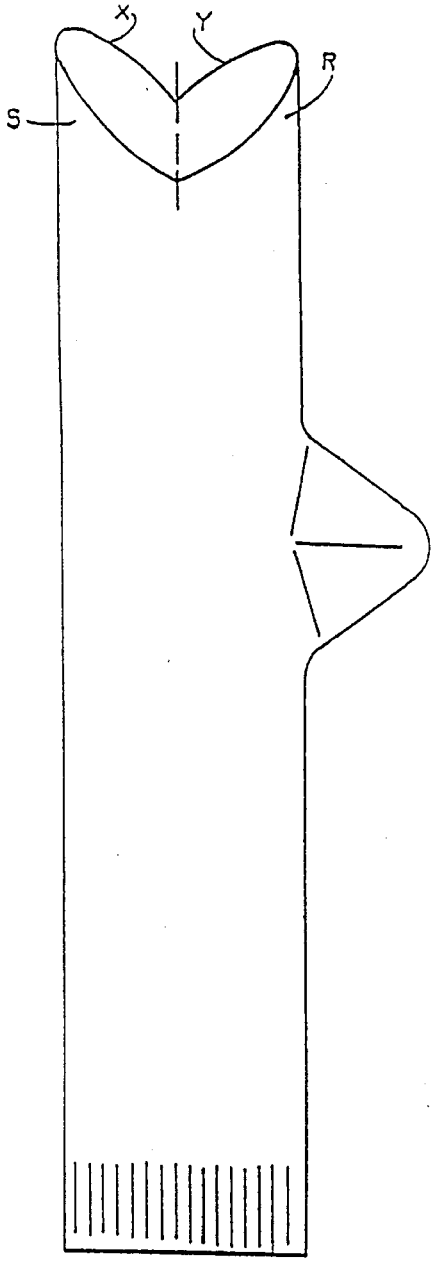
FIG. 7A is a perspective view of a sock with a so-called "fish mouth" toe formed by two semicircular and adjacent edges (S, R)
Figure 7B:
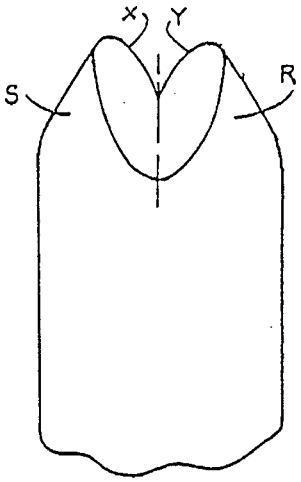
FIG. 7B is a schematic view of the sock of FIG. 7A in the second-last step of toe seaming.
Figure 7C:
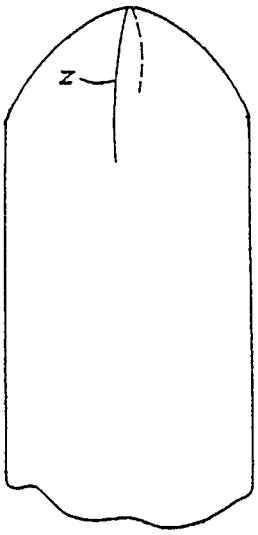
FIG. 7C is a schematic view of the sock of FIG. 7A in the final step of toe seaming.
Figure 7D:
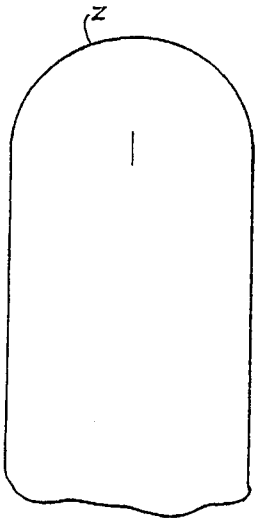
FIG. 7D is a view in longitudinal section of FIG. 7C.
Figure 8A:
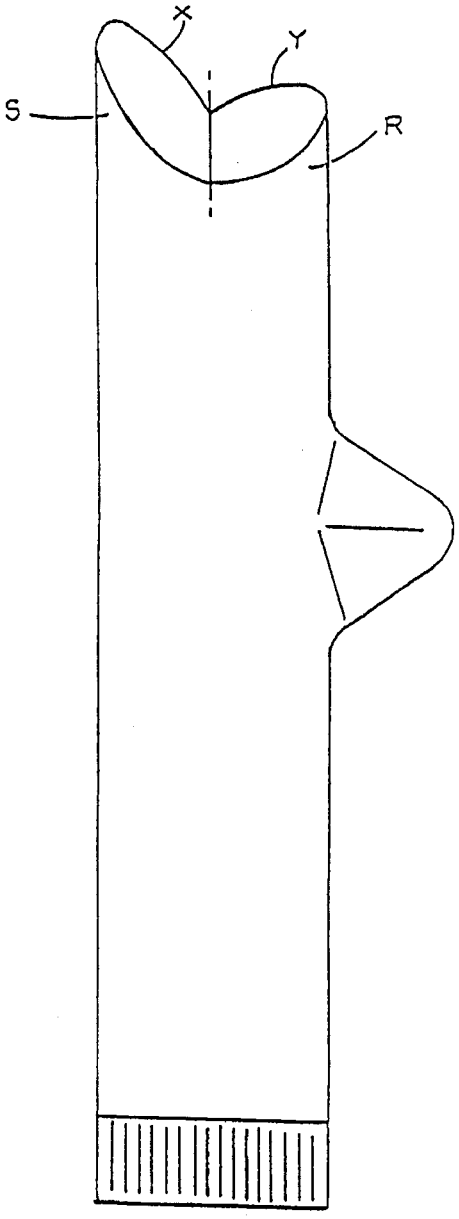
FIG. 8A is a perspective view of a sock with a so-called "shark mouth" toe formed by two edges with different number of ranks.
Figure 8B:
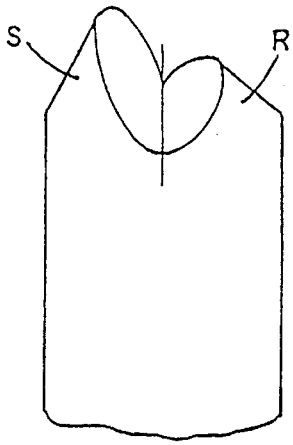
FIG. 8B shows schematically the sock of FIG. 8A in the second-last step of toe seaming.
Figure 8C:
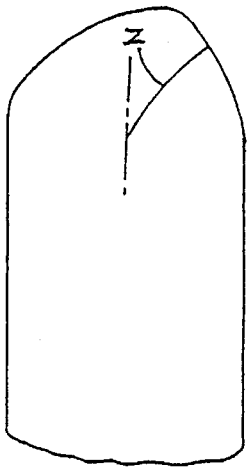
FIG. 8C is a schematic view of the sock of FIG. 8A in the final step of toe seaming.
Figure 8D:
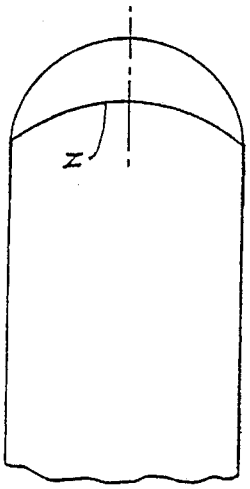
FIG. 8D is a side view of the sock in FIG. 8C.
Figure 9A:
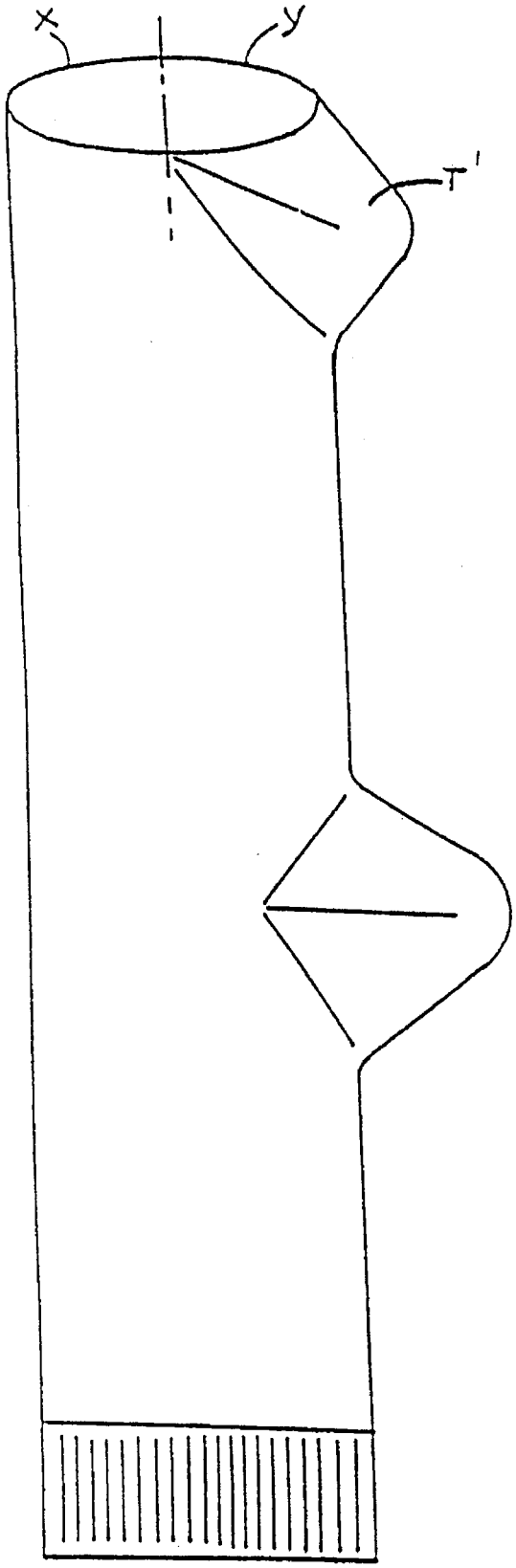
FIG. 9A is a perspective view of a sock with open toe, of traditional type.
Figure 9B:
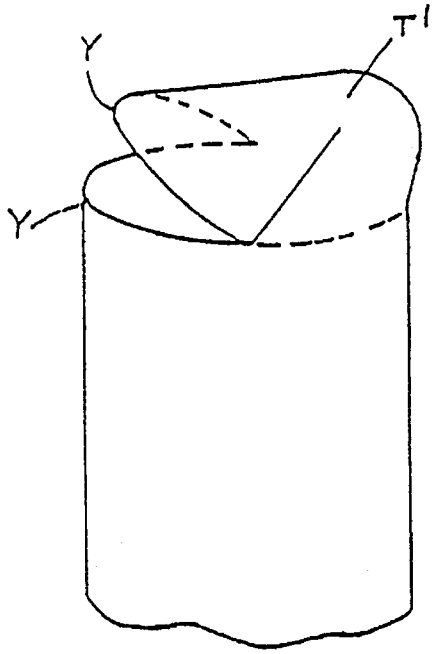
FIG. 9B is a schematic view of the sock of FIG. 9A in the second-last step of toe seaming.
Figure 9C:
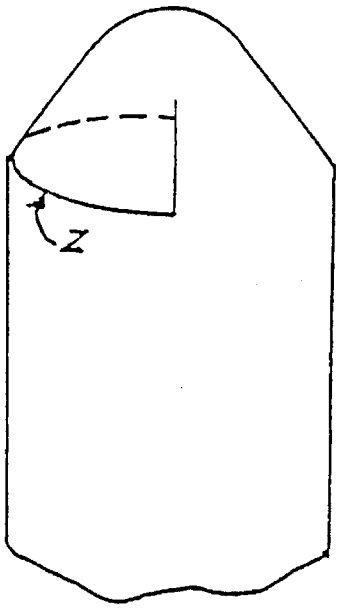
FIG. 9C is a schematic view of the sock of FIG. 9A in the final toe-seaming step.
Figure 9D:
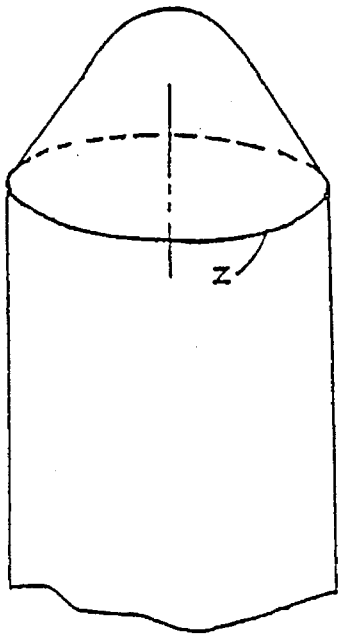
FIG. 9D is a perspective view of the sock of FIG. 9C turned 90°.

With reference to FIG. 3C of the drawings, in case of an odd number of needles (3, 7) of cylinder (1), the axis of rotation (a—a) of sector (5) is made to pass in correspondence of an end needle (7) of the second semirank and of the centre of the end needles (3, 7) of the respective semiranks; in such case, the stitches to be transferred will correspond to the total number of needles minus one and divided by two, and the number of needles (7) of the second semirank will be equal to the number of needles (3) of the first semirank plus one.

The operation, supposing the disposition of the needles (3, 7) is as shown in FIG. 3B, is as follows.

Figure 16:
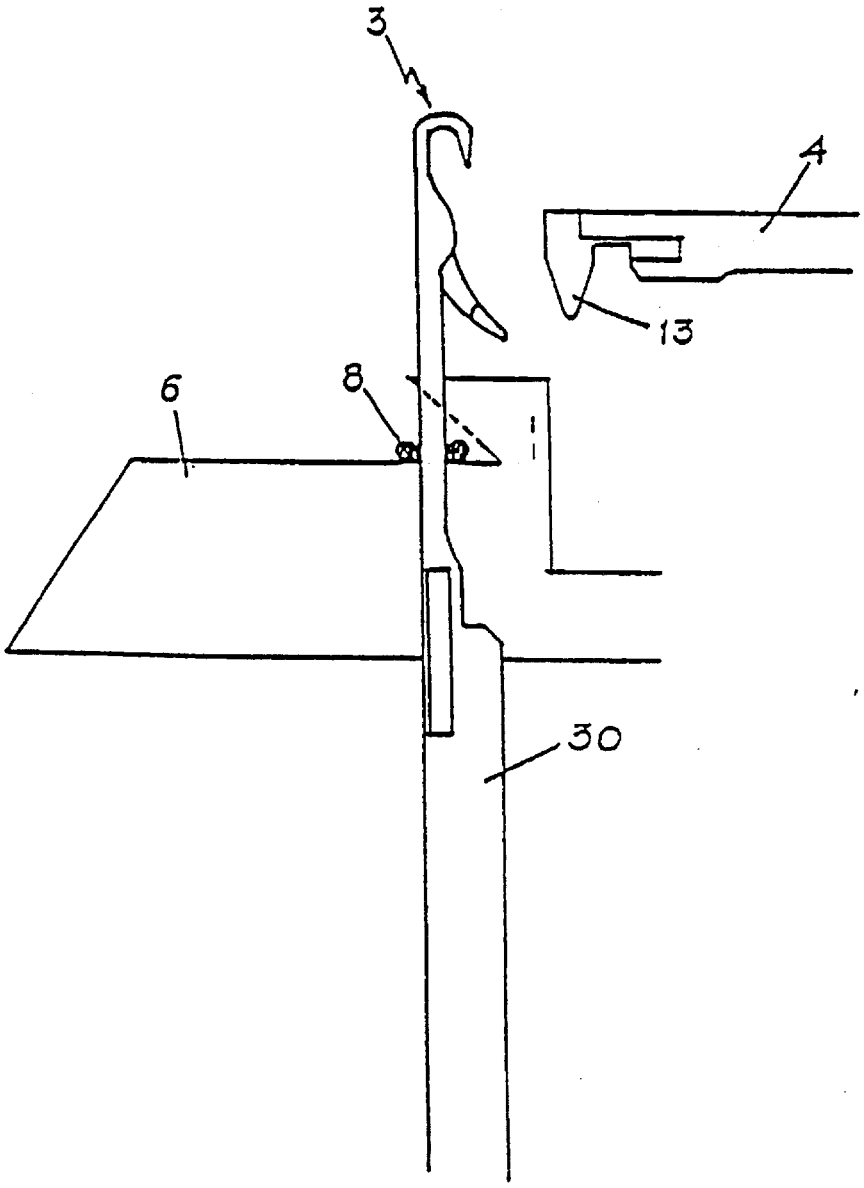
FIG. 16 is a schematic view of the needles of FIG. 10A at the beginning of a sock toe-seaming step, according to the invention.
Figure 18:
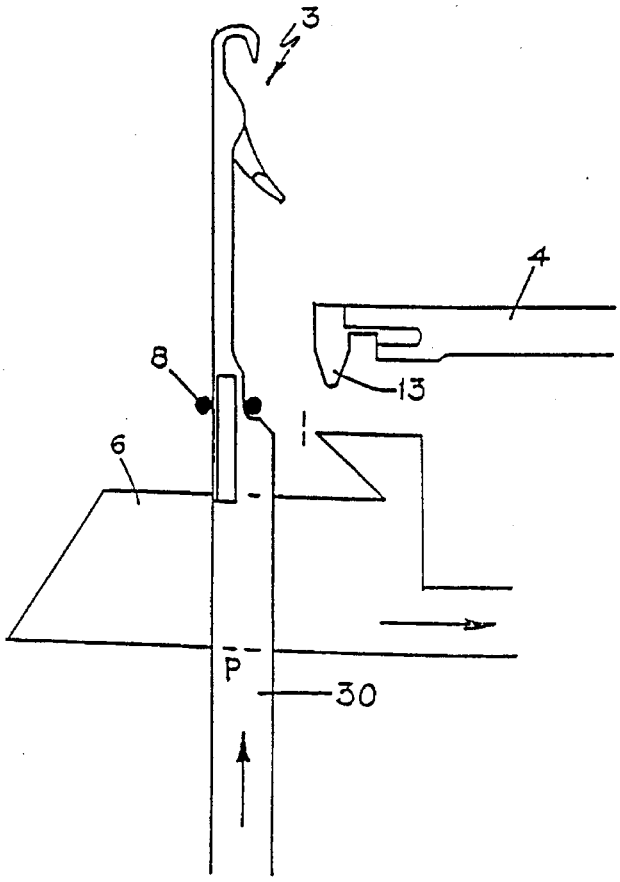
FIG. 18 shows in detail the needle of FIG. 17 in an intermediate stage of its lift travel.
Figure 19:
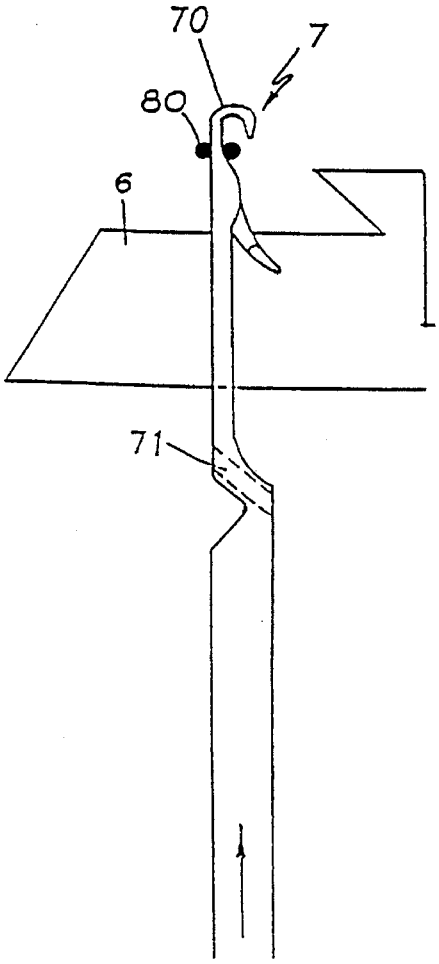
FIG. 19 shows in detail the needle of FIG. 11 in the final step of the first lift.
Figure 20:
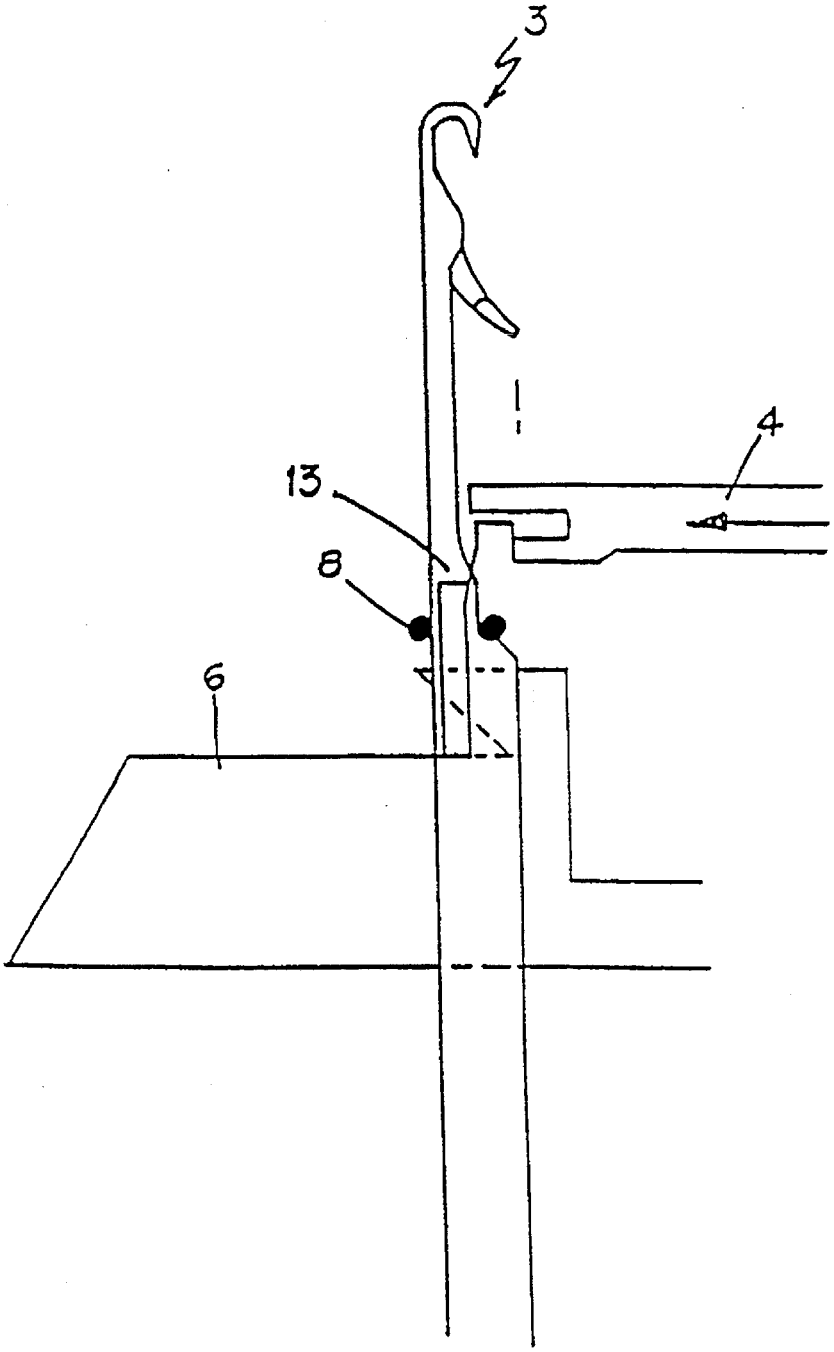
FIG. 20 shows the needle of FIG. 18 with the relevant spike during the step of moving close to the corresponding stitch.
Figure 21:
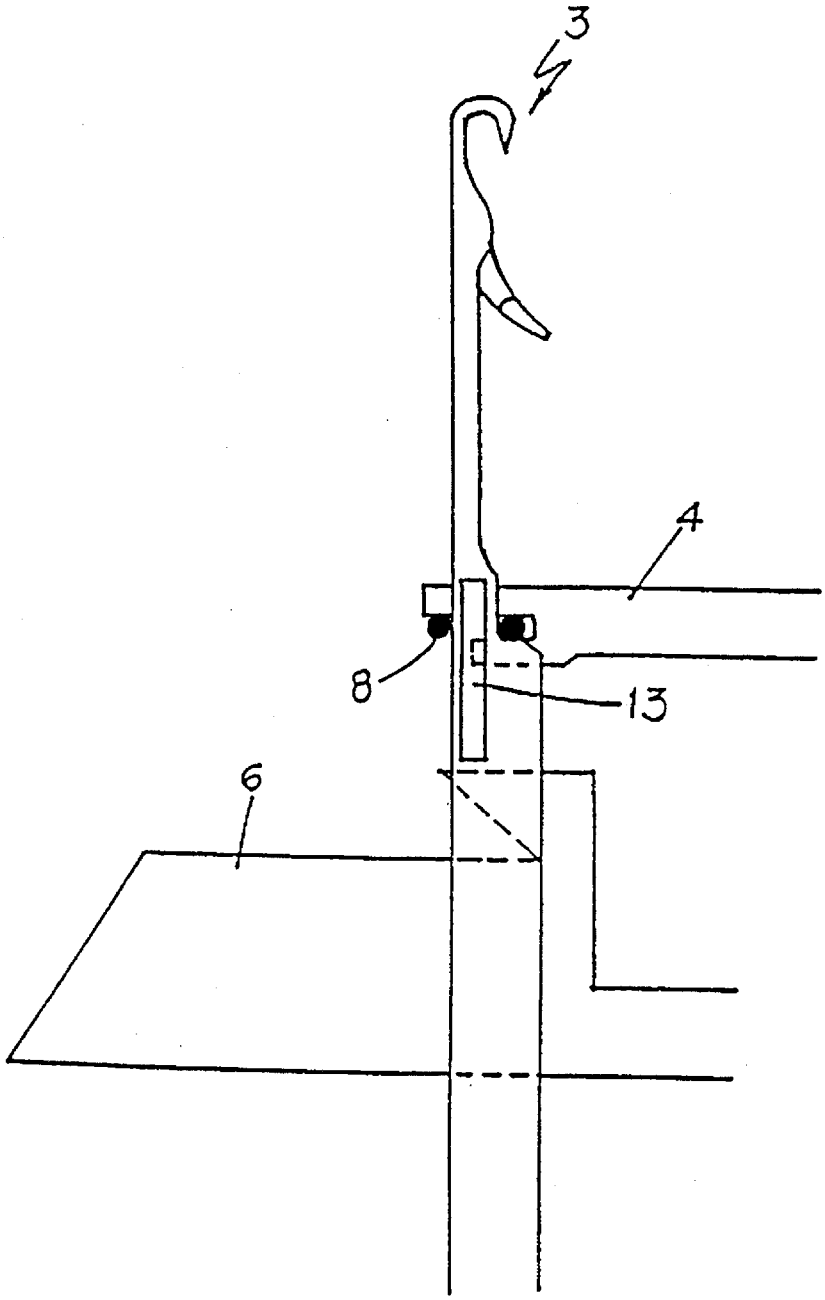
FIG. 21 shows the needle and the spike of FIG. 20 during the step of holding the relevant stitch.
Figure 22:
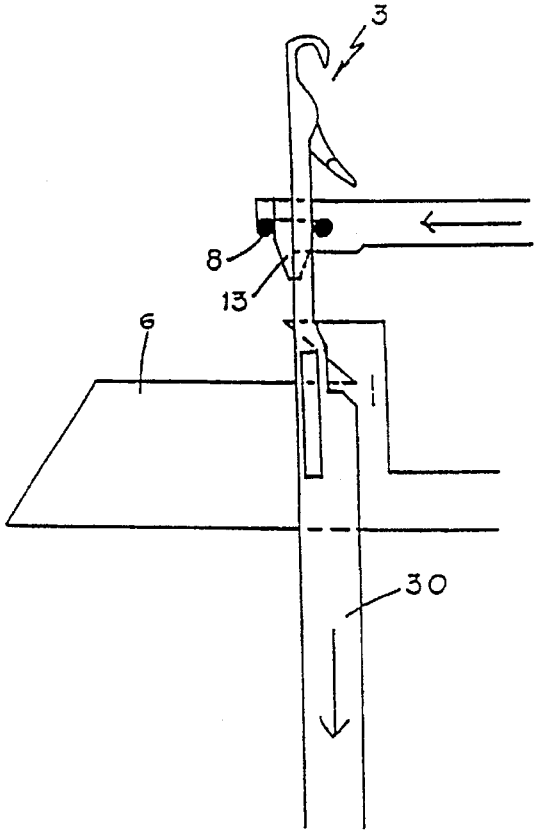
FIG. 22 shows the needle and the spike of FIG. 20 in the final step of the removal of the stitch by means of the spike.
Figure 23:
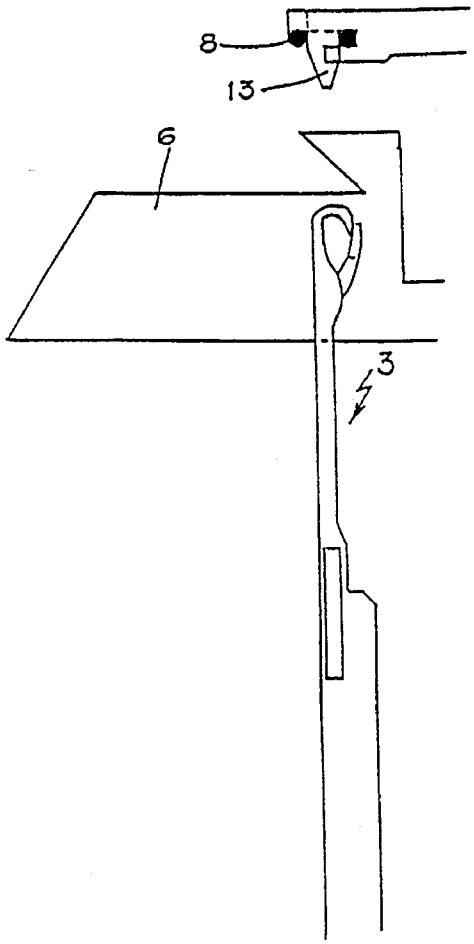
FIG. 23 shows the needle of FIG. 20 in the lowered position.

Upon completion of the knitting of the article, that is, after the execution of the last rank of stitches, each needle (3) of the last completed semirank is progressively lifted, by holding the corresponding stitch (8) by means of sinkers (6) until it reaches the removal region. Afterwards, each needle (3), with the sinkers (6) being disposed in open condition, is further lifted until the respective stitch (8) is at a level suitable for allowing the subsequent removal thereof (FIGS. 16, 17, 18). Thereafter, each needle (7) of the other semirank is progressively lifted, so as to dispose the corresponding stitch (80) at the same level as the other stitch (6) and thus avoiding an excessive stretching of the fabric (FIG. 19). Then, each needle (3) is lifted further up to lift the corresponding stitch (8) and allow it to be captured by the spikes (13) which, in the meantime, are made to advance until the heads thereof are, received within the relevant slots (31) (FIGS. 20, 21). Afterwards,, the pegs (4) of each pair of spikes (13) are moved forwards to the corresponding needle (3), so as to close the recesses (130) of the spikes (13) and thus holding the stitch (8) therein (FIG. 22). Afterwards, each needle is lowered down, thereby allowing the spikes (13) to definitively take over the stitch (8) (FIG. 23). After this operation, the rotary sector (5) is overturned through 180° over the cylinder (1) of the needles (3, 7), together with each pair of spikes (13), pegs (4) and relevant stitch (8), so that each stitch (8) is positioned on top of and coaxial to a needle (7) of the other semirank (FIG. 24).

TRANSFERRING OF THE CAPTURED STITCHES THROUGH 180°

The sector (5) is connected to a circular ring by means of two hinges (50) which are coaxial and diametrically opposite to each other, the circular ring being coaxial to the cylinder (1). The sector (5) is also provided with a horizontally-rotatable fork (51) engagable with a peg (15) which in turn is lifted when the 180° rotation of the sector (5) about the diametral axis (a—a) of the cylinder (1) is required, to obtain the 180° rotation of the sector (5) by means of a corresponding drive having skew axes. (See page 27 of the originally filed description and FIGS. 1 and 2).

Figure 24:
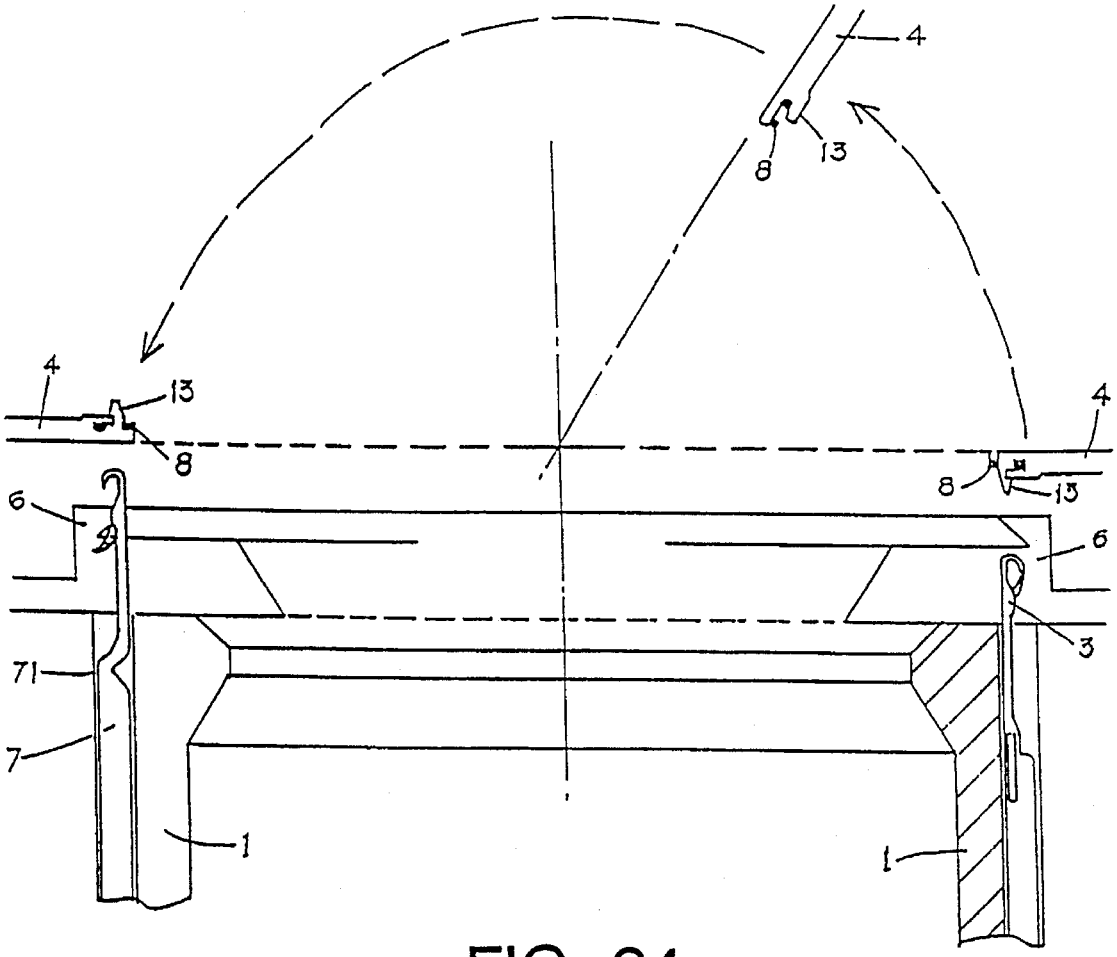
FIG. 24 is a schematic vertical sectional view of the machine of FIG. 1 upon the step of first rank stitches-overturning.

When the sector (5), which rotates connected to the cylinder (1) by means of the connection obtained through the shutter (60), must be 180° rotated about the axis (a—a) of the cylinder (1) as schematically shown in FIG. 24—the peg (15) is lifted, so that the fork (51) engages with the peg (15) and, due to this engagement and to the rotation of the sector (5) connected to the cylinder (1), the fork (51) rotates horizontally. The rotation of the fork (51) is cause for the corresponding 180° rotation (see FIG. 24) of the sector (5) by means of above-cited drive means having skew axes.

Figure 25:
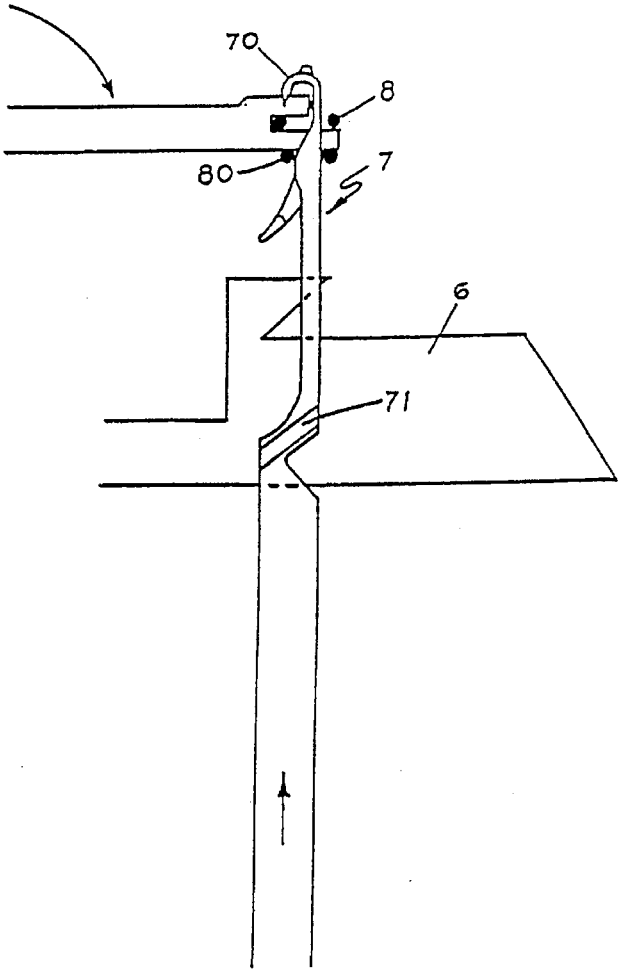
FIG. 25 shows in detail the needle of FIG. 11 during the step of intercepting the corresponding transferred stitch.
Figure 26:
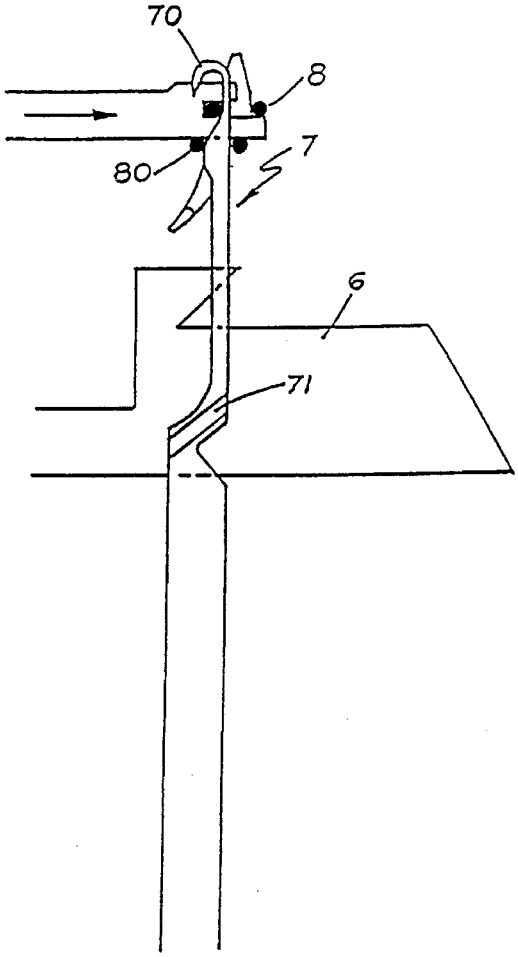
FIG. 26 shows the spike of FIG. 25 during the step of supporting the relevant stitch on the needle neck prior to the opening of the peg.
Figure 27:
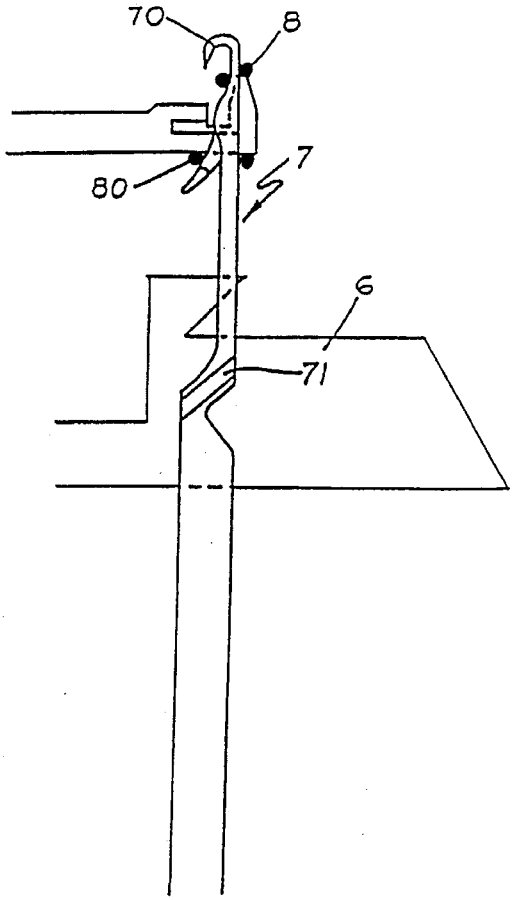
FIG. 27 shows the needle of FIG. 26 in the lifted position to release the relevant transferred stitch.

At this point, each needle (7) of the second semirank is progressively lifted to result within and beyond the corresponding stitch (8) of the first semirank. Then, each spike (13) and relevant peg (4) moved toward the needle (see arrow in FIG. 26) to press the stitch (8) on the needle and, afterwards, they are opened to release same stitch and allow the further lifting of the needle (7) to cause the complete disengagement thereof (FIGS. 25, 26, 27). In this way, each stitch (8) of the first semirank will result fitted over the neck of a needle (7) on top of the corresponding stitch (80) of the other semirank. Thereafter, the needle (7) is lowered down to result below the corresponding spikes (13). After the subsequent advancement of the spikes (13), each needle (7) is lifted up until the corresponding stitch (8, 80) is astride the respective slot (71). Then, the spikes (13) and pegs (4) associated to the stitch (8) are retracted and the needles (7) lifted further up as far as to bring the fabric to the level suitable for linking. The prearrangement of the stitches (8, 80) on the needle (7) for the linking may be accomplished with a slide (11) instead of with the spikes (13) (FIG. 29). At this point, the cylinder (1) of needles (3, 7) is driven into intermittent rotation. The linking needle (9) is moved forward of one pitch at a time and, after passing through the stitches (8, 80) into the slot (71) of each needle (7) it is fed, without loss of continuity by the crochet (10), with the thread (F) which has been used for the knitting of the article, after which it goes back by forming a plain linking chain-stitch. After the execution of the last linking stitch, the needle (9) and the relevant crochet (thread feeder for feeding linking thread to the needle linking machine) (10) operate, in cooperation with the slide (11), two or more closing knots (I, II). Then, the thread (F) is cut as follows. The linking means are retracted to allow the cutting means, that is, a thread-cutting saw known per se, to operate the cut of the thread (F). In those machines not provided with a saw, the cut is operated by scissors or blades known per se. At this point, the article is unloaded in right side out, that is, final condition, by lowering each needle (7) down to its cast off position.

Figure 14A:
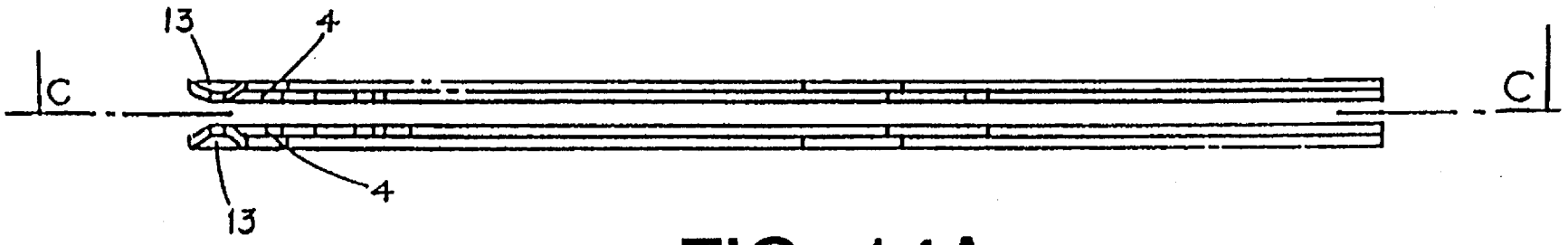
FIG. 14A is a plan view of the assembly of two spikes and relevant pegs in the opening condition.
Figure 14B:
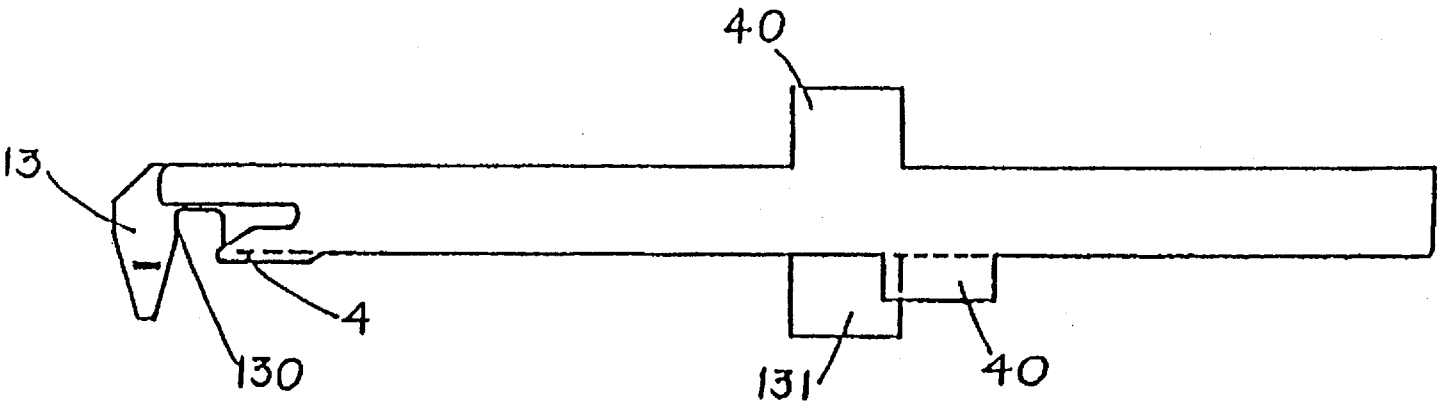
FIG. 14B is a sectional view on line C—C of FIG. 14A.
Figure 15A:
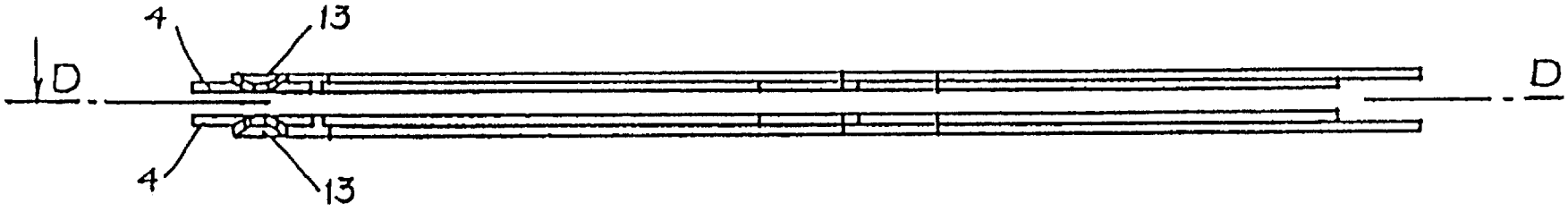
FIG. 15A is a plan view of the assembly of FIG. 14A in the closing condition.
Figure 15B:
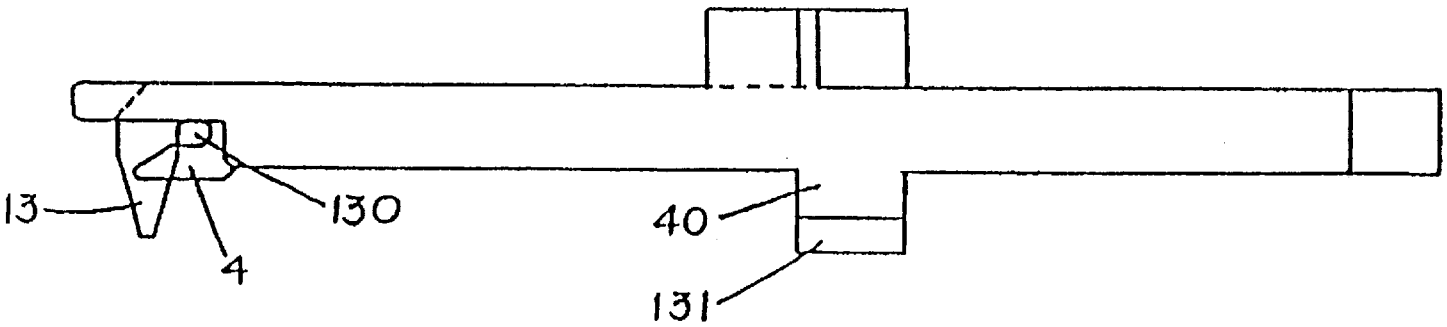
FIG. 15B is a sectional view taken on line D—D in FIG. 15A.

The opening and closing of the spikes (13)and peg (4) is shown in FIG. 12A through FIG. 15B. With reference to FIG. 12A through 15B the two positions of the peg and spike assembly are shown in FIG. 14 and 15. One such position is closed wherein a stitch may be retained or captured in the recesses 130 (FIG. 15B) and the other is an open position as in FIG. 14B. The opening and closing of the spike and peg can be activated by means of the sector cam 14 (FIG. 1) which exert its action on the butts on the spikes (13) and pegs (4) when the sector rotates together with the cylinder.

Figure 28:
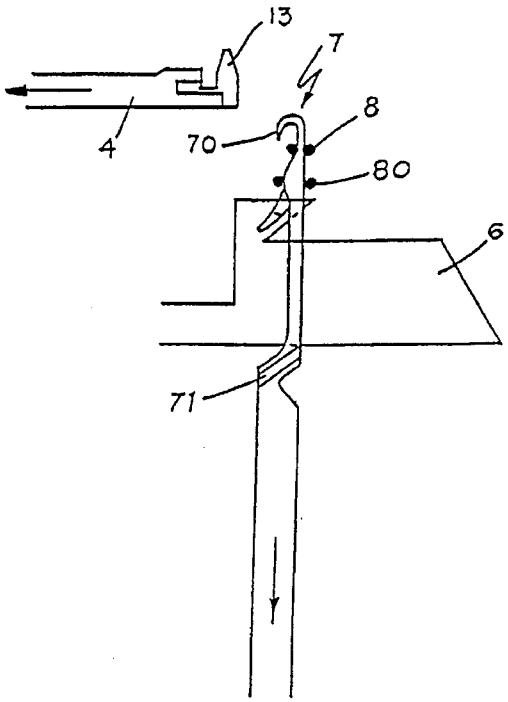
FIG. 28 shows the needle of FIG. 26 after the release of the relevant transferred stitch.

The release and transfer of the stitch (8) from the spike/peg assembly to the needle is shown in FIGS. 26, 27, and 28. As shown in FIG. 25, each needle (7) is progressively lifted. The lifting of the needle (7) acts to insert itself into the loop of the corresponding stitch (8). In this way, since needle (7) is inserted into and beyond the loop, each stitch (8) is positioned just under the hook of corresponding needle (7). This is a preloading of the stitch (8) onto needle (7). Note that at this stage it is still retained by the spike (13) and peg (4) in closed position. The lifting of needles is obtained by way of relevant lifting/lowering of cams together with the rotation of the cylinder and the butts of the needles.

At this stage, spikes (1,3) and peg (4) in the closed position is moved towards the corresponding needle (7) in order to press the stitch (8) against the needle stem (FIG. 26) by means of sector cam (14 FIG. 1). In this way the stitch (8) is disposed close to needle (7). Next, the spike is opened, to allow for the free lifting of the needle. Utilizing the physical structure of the needle, with its protruding profile at the latch pivot point, the lifting of the stitch loop (8) can be obtained while the needles are moving up. The stitch(8) is fitted over the neck of the needle at a higher level with respect to the corresponding stitch (80) of the second partial course (FIG. 27). This thereby releases or transfers the stitch (8) to the needle (7) as the peg/spike assembly retracts (FIG. 27 and 28)*.

The spikes (13) and peg (4) assembly once retracted then moves forward again to the needle (7),and at the same time needle (7) is lifted (see arrows FIG. 29). The spikes (13) once advanced press the stitches (8, 80) against stem of needle such that as the needle moves up it slides through the loop of stitches (8, 80). The stitches (8, 80) are held in a fixed position by the lower edge of the spike (13, see FIG. 29). The needle (7) is lifted to such a height that the stitches (8, 80) are positioned astride the slot(71) of needle (7, see FIG. 29). At this point, the linking needle (9) can be operated to pass through the stitches (8, 80) into the slot (71) once to spike assembly has again retracted (see FIG. 30).

LINKING STEP

As disclosed above, when each pair of stitches (8, 80) is disposed in a linking position, that is to say astride the slot (71) of the corresponding needle (7) and the needles are lifted by means of the above-cited cam means operating the lifting/lowering of the needles, the cylinder (1) is driven into intermittent rotation. Due to this intermittent rotation of the cylinder (1) there is a corresponding lifting of only one needle (7) at a time by means of the lifting cam means. At this stage, the linking needle (9) is introduced through the stitches (8, 80) of the needle (7) thus lifted, passing into the slot (71) of the needles (7) (see FIG. 30) the thread (F) for this linking operation is continuously fed by the "crochet" (10).

According to the invention, referenee being made to FIGS. 7A–7D, to perform the linking of a "fish mouth" sock toe it is sufficient that the article made by a. circular machine be provided with two equal curvilinear edges (S, R) which are then linked by the same machine according to the present method.

In case the linked is of "shark mouth" type, that is, with the seam on the side of the foot sole, it is necessary), that the terminal edges (S, R) of the article are made with a different number of ranks of stitches (FIGS. 8A–8D).

To operate the linking of a sock toe in a traditional fashion with the hook-up (z) resulting either on the back side or on the sole side, it is sufficient to make, by means the circular machine, (t') disposed on the back side of a sock with a pocket of fabric (t') disposed on either the sole or respectively the back side of the foot and then operate the hook-up of the toe according to the present method.

Practically, all the construction details may vary in any equivalent way as far as the shape, dimensions, elements disposition, nature of the used materials are concerned, without nevertheless departing from the scope of the adopted solution idea and, thereby, remaining within the limits of the protection granted to the present patent for industrial invention.

What is claimed is:

1. Method for seaming two edges of a knitted tubular article, comprising the step of manufacturing a tubular article with a single-needles cylinder circular machine, starting from the elastic hem and finishing at the side of the toe which is left open, the method comprising the steps of:

(a) lifting a predetermined number of needles of a first semirank, while holding stitches by means of sinkers, to position the stitches at a removal region of said needles;

(b) further lifting up said needles of said first semirank, with said sinkers being open, to dispose stitches at a removal level;

(c) lifting a predetermined number of needles together with stitches of a second semirank to said removal level;

(d) removing stitches of said first semirank by means provided for the transfer thereof onto corresponding needles of said second semirank;

(e) lowering said needles of said first semirank;

(f) transferring said removed stitches through a 180° overturning about an horizontal diametral axis of said needles cylinder using a transfer means, so that each stitch thus transferred will fit a corresponding needle of said second semirank;

(g) lifting said needles of said second semirank so as to load said transferred stitches of said first semirank and release them from said transfer means;

(h) placing pairs of superimposed stitches of each needle of said second semirank tightly juxtaposed and coaxial;

(i) lifting further the needles of said second semirank with stitches thus juxtaposed up to a linking level of said single needles cylinder circular machine;

(l) rotating said needles cylinder with intermittent motion and inserting, step by step, a linking needle into a pair of lifted stitches by feeding said linking needle, without loss of continuity, with a linking thread (F) used for the knitting of said knitted tubular article and then removing said linking needle to form a plain linking chainstitch;

(m) making two or more closing knots (I, II) after having executed a last linking stitch;

(n) cutting said linking thread (F);

(o) lowering said needles of said second semirank down to a cast off position to unload a finished article.

2. Method according to claim 1, wherein said step (c) is carried out as a first step, and said steps (a) and (b) as second and respectively third steps.

3. Method according to claim 1, wherein said steps (c) and (b) are carried out as a second and respectively third step.

4. Method according to claim 1, wherein during said step (e), said cylinder of needles rotates uniformly, and that said linking needle fits into said pair of stitches by following a motion of said needles cylinder said linking needle subsequently retracts to leave a trajectory of said cylinder of needles to resume an initial position.

5. Method according to claim 1, wherein after said step (g) for releasing transferred stitches, and in lieu of successive steps (h), (i), (j), (k), (l), (n) and (o), provision is made for:

(h') lifting said needles of said second semirank up to said removal level;

(i') lowering said needles of said second semirank, with said sinkers being open, to dispose transferred upper stitches in a east off condition;

(l') lifting said needles of said second semirank, with the sinkers being closed, so as to dispose the corresponding stitches in a linking attitude;

(m') lifting further up said needles of said second semirank, with the sinkers being open, so as to dispose the corresponding stitches at said linking level;

(n') rotating said cylinder of needles with intermittent motion and inserting, one pitch at a time, linking needle into each stitch thus disposed by feeding said linking needle, without loss of continuity, with a linking thread (F) used for the knitting of the article and then removing said linking needle to form a plain linking chainstitch;

(o') making two or more closing knots (I, II) after the execution of a last stitch;

(p') cutting the knitting and linking thread (F);

(q') lowering said needles of the second semirank down to a east off position, to unload a finished article.

6. Method according to claim 5, wherein during said step (n'), said cylinder of needles rotates uniformly and in that said linking needle fits into a pair of stitches by following a movement of said needles cylinder and then said linking needle moves back to leave a trajectory of said needles cylinder to resume an initial position.

7. Method according to claim 1 wherein a toe to be linked of said tubular article made by said circular machine is formed by two equal curvilinear edges (S, R) to allow a fish mouth type seam to be operated.

8. Method according to claim 1, wherein a toe to be linked of said tubular article made by said circular machine is formed by two equal curvilinear edges (S, R) to allow a shark mouth type seam to be operated.

9. Method according to claim 1, wherein the tubular article made by said circular machine is a sock provided with a fabric pocket (T') disposed on a side of a sole or on a back of said sock.

10. Apparatus for seaming two edges of a knitted tubular article, comprising:

a cylinder of needles including a plurality of needles for forming a first semirank of stitches and a plurality of needles for forming a second semirank of stitches;

a sinkers case including sinkers;

first cam means for lifting and lowering of a predetermined number of said needles of said first and said second semirank of stitches;

a second cam means for further lifting and lowering of said needles of the first and second semiranks of stitches;

means for removing stitches of said first semirank and over turning the removed stitches 180° about a horizontal diametral axis (a—a) of said cylinder of needles, including a pair of spikes for each stitch, each spike being provided with a recess located in a proximity of a spike head and being turned downwards in a removal condition, said recess intended to receive and hold therein a stitch, and with one or two corresponding opening and respectively closing pegs for each pair of spikes, which spikes and respective pegs are slidingly housed in corresponding slots of a semicircular sector and so constructed as to be moved on both sides of said sector in relation to its position relative to said cylinder of needles, said sector being rotatively mounted for a 180° angular displacement in both directions about a horizontal diametral axis (a—a) of the cylinder of needles on top of sinkers of said sinkers case;

means for fixing said sector to said cylinder of needles, with a radial shutter which, in operative mode, is engaged within a corresponding groove of said cylinder of needles upon actuation of a corresponding cam sliding between two positions, one for blocking the support of the sector to the cylinder of needles and another for releasing the support of the sector from said cylinder of needles but spaced apart by a constant and preset length;

means for blocking said sinkers case during a horizontal rotation of said sector together with the needles cylinder, with two forks supported on the stationary part of the machine and radially sliding with respect to the cylinder, said forks being associated with two corresponding vertical pins fixed to said sinkers case, and with a corresponding actuation cam which is fixed to said means for fixing said sector whereby rotation of said sector at least one of the forks with relevant pin will retain the sinkers case;

means for carrying out the linking of paired and superimposed stitches fitted on said needles of the second semirank, with a crook-shape linking needle which is fixed at a front end of a rod driven into an alternate rotary motion about an axis of said rod and, respectively, into a reciprocating translatory motion along said axis, with a corresponding crochet disposed outside said cylinder of needle, and with a fabric-holding wheel or slide to hold said stitches in a linked position during the linking said wheel or slide being located on a same side of the linking needle with respect to said needles.

11. Apparatus according to claim 10, wherein said radial slots of said sector are arranged in pairs each pair being parallel and with each pair being oriented according to a corresponding radius of said sector passing through a corresponding needle.

12. Apparatus according to claim 10, wherein said linking needle is positioned backwardly of the needles of the second semirank.

13. Apparatus according to claim 10, wherein said linking needle is positioned in front of needles of said second semirank.

14. Apparatus according to claim 10, wherein said linking needle is driven into a horizontal reciprocating oscillation motion in association with said cylinder of needles which rotates of continuous motion.

15. Apparatus according to claim 10, wherein each of said spikes is provided with two heels protruding from opposite sides but vertically aligned to allow for alternate motion inside the respective slots of said sector by means of a corresponding horizontal fixed cam, whereby said spikes are displaced in two directions with respect to said sector and said needles cylinder.

16. Apparatus according to claim 10, wherein each of said pegs is provided with two heels projecting from opposite sides and vertically offset to allow said pegs to be moved by a cam.

17. Apparatus according to claim 10, wherein said spikes are provided with a head having a wedge-like profile, in order to ease the receiving and respectively the removing of corresponding stitches to be transferred.

18. Apparatus according to claim 10, wherein said heels of spikes and pegs have a height chosen in relation to a profile of a corresponding driving cam.

19. Apparatus according to claim 10, wherein said oscillating sector is idly mounted on two corresponding cylindrical hinges horizontally coaxial and diametrically opposite to each other, which are fixed on a circular ring coaxial to said needles cylinder, said sector being provided with a fork to be engaged with a corresponding vertical drive peg to drive it into alternate rotation with 180° angular displacement by means of a corresponding drive having skew axes: said vertical peg vertically sliding between two positions including a lifted position to activate a horizontal rotation of the fork and a lowered position of rest condition.

20. Apparatus according to claim 10, wherein said needles of said first semirank are provided with a slot in each of the respective sides, to receive a head of corresponding spikes and allow said corresponding spikes to be inserted into the corresponding stitches, and a heel supplementing said needles of said first semirank, said heel to be activated by one of said cam means.

21. Apparatus according to claim 10, wherein said needles of said second semirank are provided with a heel supplementing said needles of said second semirank said heel being activated by one of said cam means, and said needles of said second semirank, being provided with a slot having an axis (b—b) inclined downwardly with respect to a longitudinal axis of a stem thereof and centrifugally with respect to said cylinder of needles, said slot being formed in a same side for all said needles of said second semirank, and being positioned to guide said linking needle.

22. Apparatus according to claim 10, wherein said slot of said needles of said first semirank has an axis inclined upwardly with respect to said longitudinal axis of said stem and centrifugally with respect to the cylinder of needles.

23. Apparatus according to claim 10, wherein said spikes are provided with a tip being bent in correspondence of said head, sideway and internally of a respective sliding direction, to allow for the insertion of said spike into a stitch of corresponding needles of the first semirank and, thereby, ensuring the capture of the relevant stitch.

24. Apparatus according to claim 10, wherein the total number of said needles of cylinder is an even number.

25. Apparatus according to claim 25, wherein the needles of said first semirank are equal in number to those of said second semirank.

26. Apparatus according to claim 25, wherein the number of needles of said second semirank is equal to that of the needles of said first semirank plus two.

27. Apparatus according to claim 10, wherein the total number of needles of said cylinder of needles is an odd number, with the number of needles of said second semirank being equal to that of said needles of said first semirank plus one.

* * * * *